US005181176A

United States Patent [19]

Hayakawa

[11] Patent Number: 5,181,176

[45] Date of Patent: Jan. 19, 1993

[54] EMBROIDERY DATA PREPARING APPARATUS

[75] Inventor: Atsuya Hayakawa, Nagoya, Japan

[73] Assignee: Brother Kogyo Kabushiki Kaisha, Nagoya, Japan

[21] Appl. No.: 592,983

[22] Filed: Oct. 4, 1990

[30] Foreign Application Priority Data

Oct. 13, 1989 [JP] Japan ..... 1-266547

[51] Int. Cl.[5] ..... G06F 15/46; D05B 21/00

[52] U.S. Cl. ..... 364/470; 112/121.12; 112/121.13; 112/266.1

[58] Field of Search ..... 364/470; 112/121.11, 112/121.12, 121.13, 266.1

[56] References Cited

U.S. PATENT DOCUMENTS 4,413,574 11/1983 Hirota et al. ..... 112/121.12

5,054,408 10/1991 Hayakawa ..... 112/266.1

*Primary Examiner*—Jerry Smith

*Assistant Examiner*—Paul Gordon

*Attorney, Agent, or Firm*—Oliff & Berridge

[57] ABSTRACT

An apparatus for preparing stitch position-related data utilized by an embroidery sewing machine, including a direction determining device for determining a reference direction with respect to an area to be embroidered, based on outline data representative of an outline of the area, the outline data including sets of position data representative of specific positions located on the outline, a block defining device for defining straight first aid lines which are perpendicular to the reference direction and each of which passes a corresponding one of the specific positions located on a first portion of the outline, and thereby dividing the area and the outline into a plurality of first blocks and a plurality of first segments, respectively, each of the first blocks being enveloped by corresponding two first aid lines and corresponding two first segments, a block modifying device for modifying the each first block by selecting, as a division base position, one of the specific positions which cooperates with the specific position associated with at least one of the two first aid lines of the each first block to define, in place of the at least one first aid line, a division line which passes the associated specific position and the division base position, and a data producing device for producing the stitch position-related data based on the each modified first block.

20 Claims, 30 Drawing Sheets

FIG. 3

| RAM | 76 |
|---|---|
| OUTLINE DATA AREA | 76a |
| DIVIDED OUTLINE DATA AREA | 76b |
| STITCHING POSITION DATA AREA | 76c |
| BLOCK DATA AREA | 76d |
| BEFORE-DIVISION STACK AREA | 76e |
| AFTER-DIVISION STACK AREA | 76f |
| MAXIMUM AND MINIMUM DATA AREA | 76g |
| LINE DATA AREA | 76h |
| VERTICES STACK AREA | 76i |
| BLOCKS STACK AREA | 76j |
| DIVIDED OUTLINES STACK AREA | 76k |

FIG. 28

| NUMBER n OF AID LINES | VERTICES | DIVISION BASE POSITION CANDIDATES |
|---|---|---|
| 0 | $P_{MIN}$ | $P_{MIN}$ |
| 1 | $P_1$ | $D_1$ |
| ⋮ | ⋮ | ⋮ |
| n-1 | $P_{n-1}$ | $D_{n-1}$ |
| n | $P_n$ | $D_n$ |
| n+1 | $P_{n+1}$ | $D_{n+1}$ |
| ⋮ | ⋮ | ⋮ |
| N | $P_{MAX}$ | $P_{MAX}$ |

FIG. 29
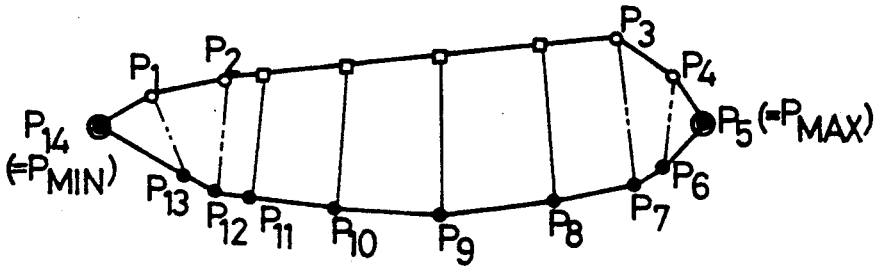
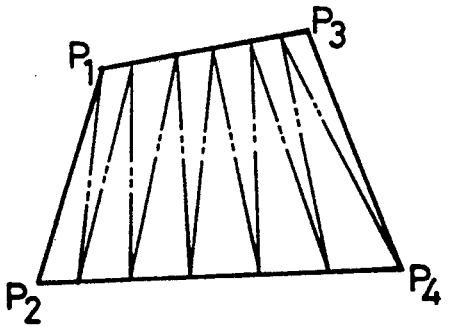
FIG. 30

EMBROIDERY DATA PREPARING APPARATUS

BACKGROUND OF THE INVENTION

1. Field Of The Invention

The present invention generally relates to an apparatus for preparing stitch position-related data utilized by an embroidery sewing machine, and particularly to such an apparatus which automatically prepares stitch position-related data utilized by an embroidery sewing machine to embroider a predetermined area by forming stitches at respective stitch positions and thereby filling the area with the formed stitches.

2. Related Art Statement

The Applicant has filed U.S. patent application Ser. No. 07/523,379 on May 15, 1990, in which he proposes an apparatus for automatically preparing stitch position-related data utilized by an embroidery sewing machine. The proposed apparatus includes (a) direction determining means, (b) block defining means, and (c) data producing means. The direction determining means determines a reference direction with respect to a predetermined area to be embroidered, based on outline data representative of an outline of the area. Specifically, the direction determining means determines as the reference direction, for example, the direction of a straight line approximating the predetermined area (hereinafter, referred to as the longitudinal direction of the area for the reason indicated later). The block defining means defines straight aid lines which are perpendicular to the longitudinal direction and respectively pass all the specific positions predetermined on the outline, and thereby dividing the area and the outline into blocks and segments, respectively.

In the case where the outline of a predetermined area to be embroidered includes a proper polygon, or a curved line which is not a polygon but is approximated by a polygon, the outline data may include sets of position data (e.g., sets of coordinate data in an X-Y orthogonal coordinate system) each of which is representative of a corresponding one of the vertices defining the polygon. In addition, in the case where the outline is approximated by a function such as a spline function, the outline data may include data representative of the function. If the outline consists of a polygon, the specific positions located on the outline may consist of the vertices of the polygon and the outline data may consist of the sets of position data representative of the vertices. If the outline is approximated by a function, the specific positions may consist of the points defined by the function and the outline data may consist of the sets of position data representative of the points.

The data producing means produces, based on the blocks resulting from the division of the area, stitch position-related data which is utilized by the embroidery sewing machine to form stitches and thereby fill the area with the stitches.

As is apparent from the foregoing, the proposed apparatus determines a straight line approximating a predetermined area to be embroidered, and utilizes the direction of the straight line, or longitudinal direction of the area, as an embroidering direction of the area in which direction to form stitches in the area. However, the apparatus divides the area into blocks by straight aid lines perpendicular to the longitudinal direction, irrespective of the profile or shape of the area or outline thereof. In the case where the area to be embroidered is approximated by a curved line or polygonal line (hereinafter, referred to as the central line of the area), there may occur a considerably large difference or deflection between the longitudinal direction of the area, and directions of the central line at individual positions or portions thereof (hereinafter, referred to as the central-line direction of the area). Obviously, the central-line direction serves as the more suitable embroidering direction than the longitudinal direction. Therefore, some of the blocks obtained by dividing the area by straight aid lines perpendicular to the longitudinal direction, may not appropriately reflect the central-line direction. Regarding a polygon shown in FIG. 31, the proposed apparatus determines as the longitudinal direction of the polygon, for example the direction of a straight line passing the most distant, or approximately the most distant, two vertices of the polygon (e.g., vertices $P_{MIN}$ and $P_{MAX}$) However, as is seen in the figure, the polygon is more suitably approximated by an arc than the straight line defining the longitudinal direction. Therefore, the tangential direction of the arc as the central-line direction, serves as the more suitable embroidering direction. If, as shown in FIG. 31, the polygon is divided into blocks by straight aid lines perpendicular to the longitudinal direction, at least some of the blocks do not appropriately reflect the tangential direction of the arc. When the polygon is embroidered by alternately and successively connecting, with thread, between stitch positions provided on one of the two segments of each block which are opposed to each other in the direction perpendicular to the longitudinal direction, and stitch positions provided on the other segment of the each block, the embroidering direction for the at least some blocks (indicated at arrows in FIG. 31) will not appropriately coincide with the tangential direction of the arc in the zone of those blocks, thereby adversely affecting the quality of an embroidery as a whole formed in the polygon.

SUMMARY OF THE INVENTION

It is therefore an object of the present invention to provide an apparatus for preparing stitch position-related data which appropriately reflects the central-line direction of a predetermined area to be embroidered.

The above object has been achieved by the present invention which provides an apparatus for preparing stitch position-related data utilized by an embroidery sewing machine to embroider a predetermined area by forming stitches at respective stitch positions and thereby filling the area with the formed stitches, comprising (a) direction determining means for determining a reference direction with respect to the area based on outline data representative of an outline of the area, the outline data including a plurality of sets of position data each of which is representative of a corresponding one of a plurality of specific positions predetermined on the outline, (b) block defining means for defining a plurality of straight first aid lines which are perpendicular to the reference direction and each of which passes a corresponding one of the specific positions located on a first portion of the outline and intersects a second portion of the outline different from the first portion, and thereby dividing the area and the outline into a plurality of first blocks and a plurality of first segments, respectively, each of the first blocks being enveloped by corresponding two of the first aid lines which are opposed to each other and corresponding two of the first segments which are opposed to each other, (c) block modifying means for modifying the each first block by selecting, as a division base position, one of the specific positions located on the second portion of the outline which one position cooperates with the specific position associated with at least one of the opposed two first aid lines of the each first block to define, in place of the at least one first aid line, a division line which passes the associated specific position on the first portion of said outline and the division base position on the second portion of the outline, and (d) data producing means for producing the stitch position-related data based on the each modified first block.

In the apparatus constructed as described above, the block modifying means modifies the each first block by selecting, as a division base position, one of the specific positions which cooperates with the specific position associated with at least one of the opposed two first aid lines of the each first block to define, in place of the at least one first aid line, a division line which passes the associated specific position on the first portion of the outline and the division base position on the second portion of the outline. The first and second portions of the outline extends generally in the reference direction of the outline such that the two portions are opposed to each other in the direction perpendicular to the reference direction. The block modifying means determines the division base position so that the each block modified by the division base position determined reflects the central-line direction of the area to be embroidered. While a division base position may be determined based on a specified direction approximating the central-line direction in the zone of each block, it is also possible to determine the division base position in a manner which does not use such a specified direction but utilizes an empirically found relationship reflecting the central-line direction. Anyway, the data producing means produces the stitch position-related data based on the each modified block reflecting the central-line direction. When an embroidery sewing machine forms stitches by utilizing the stitch position-related data, the formed stitches fill the area in the central-line direction thereof, thereby providing an embroidery of high quality. Further, since the block modifying means of the present apparatus utilizes the specific positions predetermined on the outline, for the division base positions, the modified first blocks obtained by the present apparatus is reduced in number as compared with that of the modified blocks which are obtained by determining the division base positions for all the specific positions in a manner which allows the division base positions to be located at positions on the outline other than the specific positions. By the way, while the reference direction determining means normally determines a reference direction for an area based on only the outline of the area, the means may determine the direction with considerations of its possible near area or areas to be embroidered together therewith. In the case where a plurality of areas near to each other are embroidered, it is desirable to determine an appropriate embroidering direction for those areas as a whole. The outline of the area to be embroidered may be not only a polygon but also a closed curve.

According to a feature of the present invention, the direction determining means determines the most distant, or approximately the most distant, two positions of the specific positions on the outline, as a maximum and a minimum position of the outline, and determines a direction of a straight line passing the maximum and minimum positions as a longitudinal direction of the outline, the longitudinal direction serving as the reference direction determined with respect to the area, the first portion of the outline being one of a pair of opposed portions of the outline which is opposed with respect to the maximum and minimum positions to the other portion serving as the second portion of the outline. The first and second portions of the outline extends generally in the longitudinal direction of the outline.

According to another feature of the present invention, the block defining means compares a number of the specific positions located on the one of the opposed portions of the outline, with a number of the specific positions located on the other portion of the outline, and determines a the first portion of the outline one of the opposed portions of the outline which one portion includes a smaller number of specific positions.

According to yet another feature of the present invention, the block modifying means comprises means for defining a plurality of straight second aid lines which are perpendicular to the longitudinal direction and each of which passes a corresponding one of the specific positions located on the second portion of the outline and intersects the first portion of the outline, the second aid lines cooperating with the first aid lines to divide the area and the outline into a plurality of second blocks and a plurality of second segments, respectively, each of the second blocks being enveloped by corresponding two of the first and second aid lines which are opposed to each other and corresponding two of the second segments which are opposed to each other.

According to a further feature of the present invention, the block modifying means comprises means for determining a first vector starting at one of opposite ends of one of the opposed two segments of each of the second blocks and ending at the other end of the one segment, a second vector starting at one of opposite ends of the other segment which end is opposed to the one end of the one segment and ending at the other end of the other segment which end is opposed to the other end of the one segment, and a third vector which starts at a position on one of the opposed two aid lines of the each second block, extends in a direction of a vector obtained by addition of the first and second vectors, and ends at a position on the other aid line, the end position on each of the first and second aid lines at which the third vector determined for one of the two second blocks adjacent to the each aid line ends serving simultaneously as the start position on the each aid line at which the third vector determined for the other block starts, the minimum position serving as either the start ends or the end ends for both the first and second vectors for the block to which the minimum position belongs and simultaneously as either the start position or the end position for the block to which the minimum position belongs, while the maximum position serving as either the end ends or the start ends for both the first and second vectors for the block to which the maximum position belongs and simultaneously as either the end position or the start position for the block to which the maximum position belongs, means for determining with respect to each of the first aid lines a fourth vector by addition of the third vectors determined for the two blocks adjacent to the each first aid line, and means for defining a straight reference line which passes the specific position associated with the each first aid line and is perpendicular to the fourth vector. Alternatively, a straight line which passes a specific position and is perpendicular to a third vector determined for one of the two second blocks adjacent to (i.e., on both sides of) a first aid line passing the specific position, may be determined as a reference line. In addition, in place of the third vector, it is possible to use a straight segment connecting a middle position of one of inside portions of the opposed two aid lines of the each block which portions are located inside the outline and a middle position of the other inside portion. In this connection, it is noted that the start and end position on the each first and second aid line is a middle position of an inside portion of the each aid line inside the outline. The fourth direction may be determined based on the three or more third vectors determined for the three or more blocks near the each first and second aid line. In the latter case, it is desirable to give different factors to the individual blocks so that the more distant the blocks are away from the each aid line the less influence thereof is on the fourth direction for the each aid line. The fourth direction reflects the central-line direction of the area in the location of the each first and second aid line.

According to another feature of the present invention, the block modifying means comprises means for determining an intersection of the each first aid line and the second portion of the outline, and determining two of the specific positions on the second portion which positions are adjacent to the intersection and located on both sides of the intersection, respectively, as a preceding and a following specific position for the associated specific position, and means for comparing a first angle contained by the reference line and a first straight line defined by the preceding specific position and the associated specific position, with a second angle contained by the reference line and a second straight line defined by the following specific position and the associated specific position, the block modifying means determining as the division base position one of the preceding and following specific positions which provides the smaller one of the first and second angles, the each modified first block being defined by the outline and the division lines determined with respect to the opposed two aid lines of the each first block.

According to yet another feature of the present invention, the block modifying means comprises means for, if the first and second angles are equal to each other, comparing a third angle contained by the each first aid line and the first straight line, with a fourth angle contained by the each first aid line and the second straight line, the block modifying means determining as the division base position one of the preceding and following specific positions which provides the smaller one of the third and fourth angles.

According to a further feature of the present invention, the block modifying means comprises first judging means for judging whether or not the preceding specific position is located between the intersection, and an intersection of the second portion of the outline and the first aid line associated with one of the two specific positions on the second portion of the outline which positions are adjacent to the specific position associated with the each first aid line and located on both sides of the associated specific position, respectively, second judging means for judging whether or not the following specific position is located between the intersection and an intersection of the second portion of the outline and the first aid line associated with the other of the two specific positions, the block modifying means determining as the division base position a middle position of a straight segment connecting between the preceding and following specific positions if both the first and second judging means provide negative judgements, the block modifying means determining as the division base position the preceding specific position if the first and second judging means provide an affirmative and a negative judgement, respectively, the block modifying means determining as the division base position the following specific position if the first and second judging means provide a negative and an affirmative judgement, respectively, the block modifying means determining the division base position based on the comparison result of the means for comparing the first and second angles, if both the first and second judging means provide affirmative judgements.

According to another feature of the present invention, the block modifying means comprises means for determining one or more positions on the first portion of the outline which positions are not the specific positions of the first portion, as the division base positions for one or more of the specific positions on the second portion of the outline which one or more positions are not determined as the division base positions for the one or more specific positions of the first portion of the outline.

According to another feature of the present invention, the data producing means comprises means for producing, as the stitch position-related data, block data representative of the each modified first block, the block data comprising two sets of position data representative of the two specific positions associated with the opposed two first aid lines of the each first block and two sets of position data representative of the division base positions determined with respect to the opposed two first aid lines.

According to yet another feature of the present invention, the data producing means further comprises means for producing based on the block data stitch position data representative of stitch positions which the embroidery sewing machine alternately connects with thread to form the stitches and thereby fill the area with the formed stitches, the stitch position data serving as the stitch position-related data.

According to a further feature of the present invention, the outline comprises a polygon and the specific positions comprise a plurality of vertices of the polygon, the data producing means comprising means for producing as the stitch position-related data block data representative of the each modified first block, the block data comprising two sets of position data representative of the two vertices associated with the opposed two first aid lines of the each first block and two sets of position data representative of the two division base positions determined with respect to the opposed two first aid lines.

In the case where a division base position is determined based on a third or fourth vector for each second block or each first and second aid line, it is desirable that, before the determination of the third or fourth vector, an area to be embroidered be divided into sub-areas so that a deflection between the reference or longitudinal direction determined for each sub-area and the central-line direction of the each sub-area be as small as possible, because the third or fourth direction reflects the central-line direction on one hand but on the other hand it depends upon the profile of the each second block that is defined by the first and second aid lines perpendicular to the reference or longitudinal direction.

According to a feature of the present invention, the apparatus further comprises deflection position finding means for rotating the outline in an X-Y coordinate system so that the longitudinal direction of the outline becomes parallel to one of the X and Y axes of the X-Y coordinate system, and successively checking the specific positions in an order of location thereof on the outline, for a deflection position, by judging whether or not a sign of a value obtained by subtracting a value with respect to the one axis of a currently checked position from that of a following position which subsequently is checked, is same as that of a value obtained by subtracting a value with respect to the one axis of a preceding position which has just been checked from that of the currently checked position, the deflection position finding means determining, if a negative judgement is made, the currently checked position as the deflection position.

According to another feature of the present invention, the apparatus further comprises deflection direction determining means for determining whether or not the deflection position is an outward deflection position, the deflection direction determining means determining, in the case where the deflection position finding means successively checks the specific positions on the outline in a clockwise direction, the deflection position as the outward deflection position if the following position of the deflection position is located on a left-hand side thereof as viewed in a direction of a vector starting at the preceding position of the deflection position and ending at the deflection position, the deflection direction determining means determining, in the case where the deflection position finding means successively checks the specific positions on the outline in a counterclockwise direction, the deflection position as the outward deflection position if the following position is located on a right-hand side of the deflection position as viewed in the direction of the vector. The deflection position finding means and deflection direction determining means may be adapted to find an outward deflection position by effecting either the clockwise or counterclockwise checking of the specific positions on the outline.

According to yet another feature of the present invention, the apparatus further comprises means for dividing the outline into first divided outlines so that each of the first divided outlines has no outward deflection position.

According to a further feature of the present invention, the apparatus further comprises means for determining the most distant, or approximately the most distant, two positions of the specific positions on the each first divided outline, and judging whether or not all segments obtained by connecting each of the distant two positions and each of the other specific positions on the each first divided outline are contained inside the each first divided outline.

According to another feature of the present invention, the apparatus further comprises means for dividing the each first divided outline into second divided outlines so that all segments obtained by connecting each of the distant two positions of each of the second divided outlines and each of the other specific positions on the each second divided outline are contained inside the each second divided outline.

Thus, the area to be embroidered is divided into sub-areas so that a deflection between the longitudinal direction for each sub-area and the central-line direction thereof be as small as possible, even though the area before the division might have a considerably large deflection between the longitudinal and central-line directions. Generally, each second divided outline becomes nearer to a circle.

According to yet another feature of the present invention, the direction determining means determines a direction of a straight line passing the distant two positions of the each second divided outline, as the longitudinal direction of the each second divided outline.

According to a further feature of the present invention, the block defining means divides the each second divided outline into the each block, the block modifying means modifies the each block, and the data producing means produces as the stitch position-related data block data representative of the each modified block.

BRIEF DESCRIPTION OF THE DRAWINGS

The above and optional objects, features and advantages of the present invention will be better understood by reading the following detail description of the presently preferred embodiment of the invention when considered in conjunction with the accompanying drawings, in which:

FIG. 3 is an illustrative view of a random access memory (RAM) of a computer which constitutes a major part of the control device;

FIG. 28 is a table indicating line data stored in a line data area of the RAM of the computer;

FIG. 29 are a view for explaining the routine of FIG. 10;

FIG. 30 is a view for explaining the preparation of stitching position data for a block of a predetermined area to be embroidered;

DETAILED DESCRIPTION OF THE PREFERRED EMBODIMENT

Figure 1:
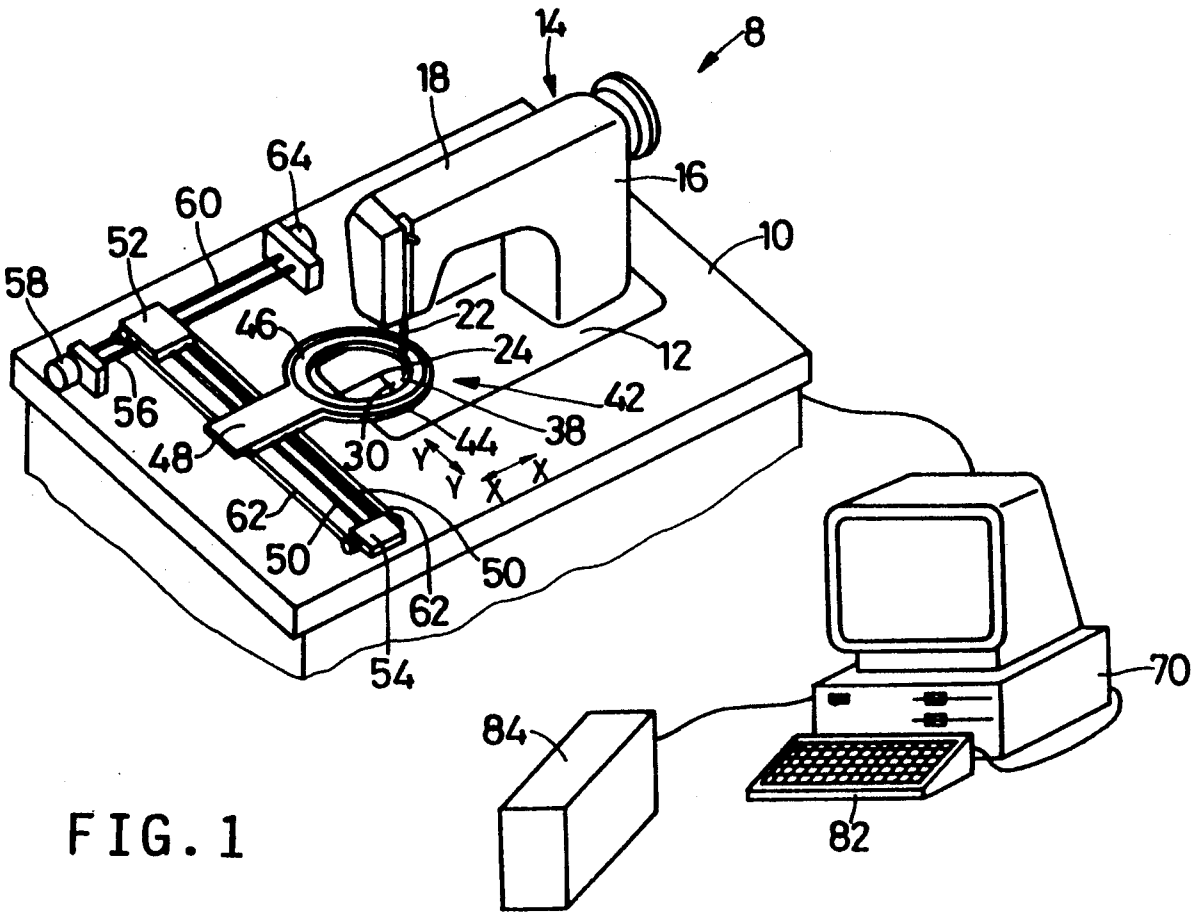
FIG. 1 is a perspective view of an embroidery sewing machine system which incorporates a data producing apparatus embodying the present invention.

Referring first to FIG. 1, there is shown an embroidery sewing machine system embodying the present invention. The system includes an embroidery sewing machine 8.

In FIG. 1, reference numeral 10 designates a table of the sewing machine 8 on which a bed 12 and a main frame 14 are provided. The main frame 14 includes a column 16 extending vertically from the bed 12, and an arm 18 extending horizontally from the upper portion of the column 16 like a cantilever. A needle bar 22 is connected to the main frame 14 via a needle bar frame (not shown), such that the needle bar 22 is vertically displaceable. A needle 24 is secured to the lower end of the needle bar 22. The needle bar 22 is coupled to a main motor 26 (FIG. 2) via a needle bar connecting bracket and other members (not shown). The needle bar 22 or needle 24 is reciprocated vertically when the main motor 26 is operated. The bed 12 has an opening formed in the upper surface thereof. A throat plate 30 having a needle aperture 38, is adapted to close the opening of the bed 12.

An embroidery frame 42 is mounted on the table 10, such that the embroidery frame 42 is movable in an X and a Y directions which are perpendicular to each other. The embroidery frame 42 includes an outer frame 44 having a ring portion, and an inner frame 46 adapted to be fitted in the ring portion of the outer frame 44. The embroidery frame 42 supports a work fabric (not shown) between the outer and inner frames 44, 46. The outer frame 44 has a slide portion 48 extending from the ring portion thereof in a direction parallel to the X direction and away from the column 16. The slide portion 48 is slidably engaged with a pair of guide pipes 50, 50 extending in the Y direction. The two pairs of corresponding opposite ends of the guide pipes 50 are connected by a first and a second connecting member 52, 54, respectively. The first connecting member 52 is supported on a feed screw 56 and a rotation transmission bar 60 each extending in the X direction, and is displaced in the X direction when the feed screw 56 is rotated by an X drive motor 58. The second connecting member 54 is supported by the bed 10 via a ball member (not shown) which is rotatably secured to the second connecting member 54. The ball member is displaceable together with the second connecting member 54 as a unit. A pair of endless wires 62, 62 are engaged with the slide portion 48 and the first and second connecting members 52, 54. When the rotation transmission bar 60 is rotated by a Y drive motor 64, the wires 62 are displaced, so that the slide portion 48 is displaced in the Y direction. By means of the combination of the X direction movement of the first connecting member 52 and the Y direction movement of the slide portion 48, the embroidery frame 42 is moved to any position in a horizontal plane. This embroidery frame movement cooperates with the needle reciprocatory movement to enable a predetermined area on the work fabric to be embroidered.

Figure 2:
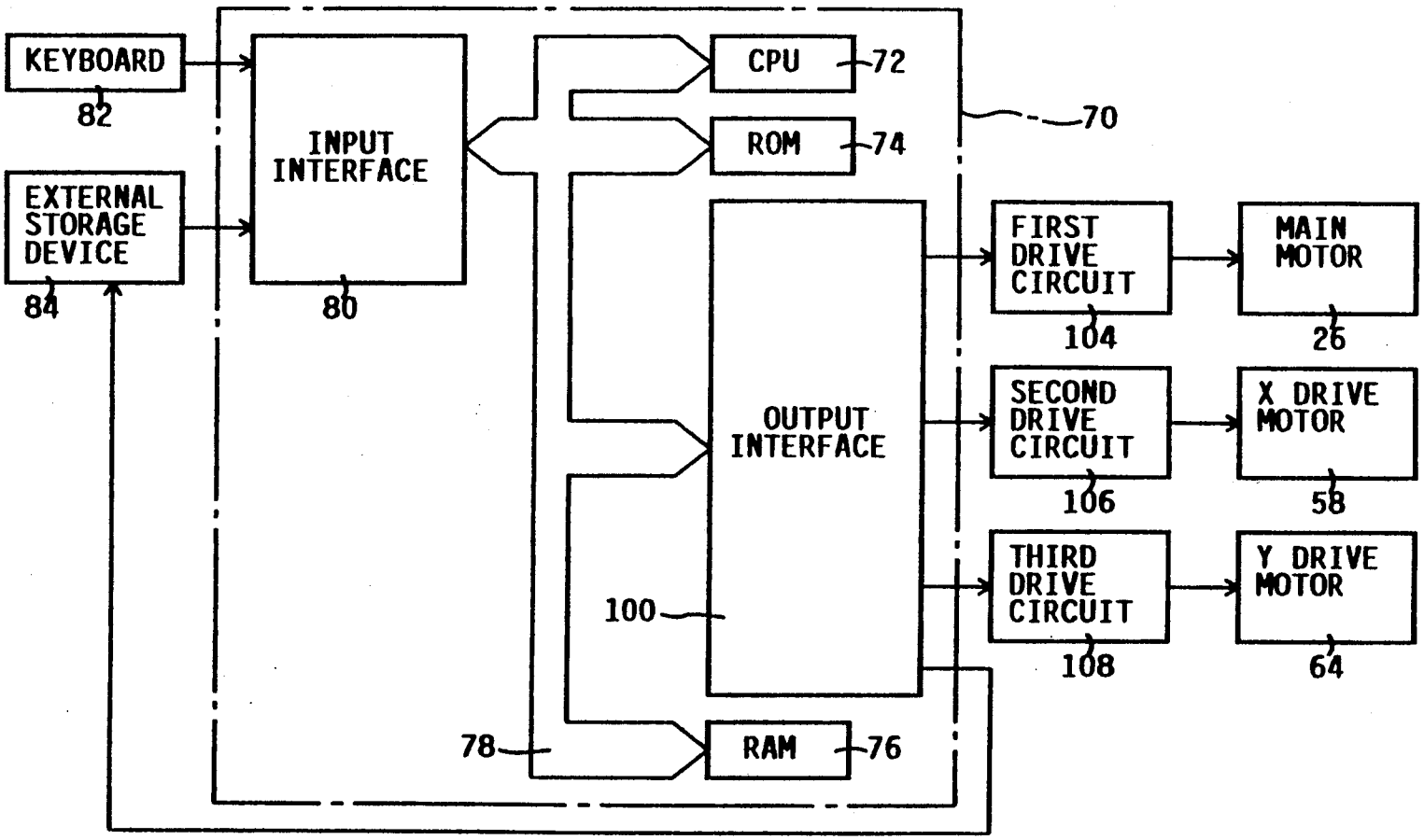
FIG. 2 is a diagrammatical view of a control device for controlling the operation of the system of FIG. 1.
Figure 4A:
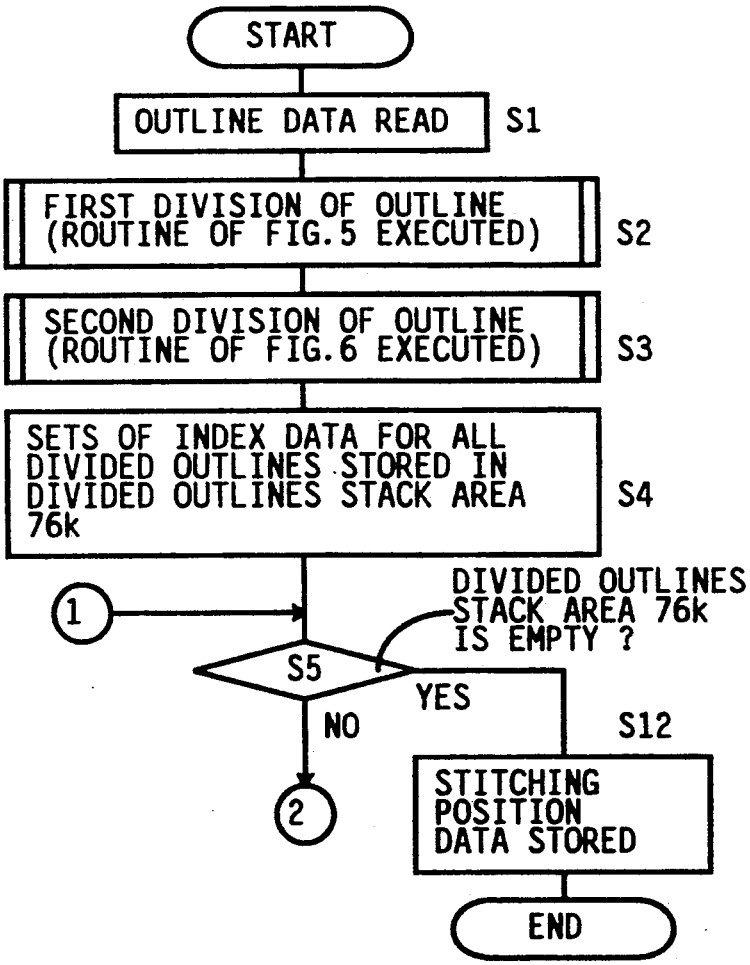
FIGS. 4A and 4B shows a flow chart illustrating the stitching position data preparation routine stored in a read only memory (ROM) of the computer.
Figure 4B:
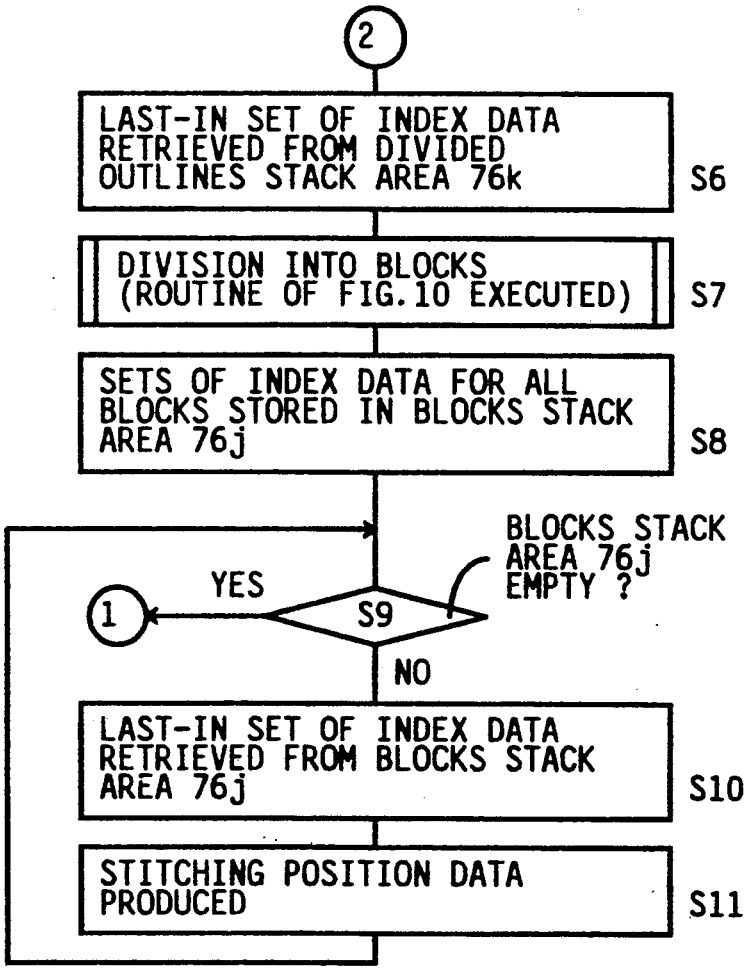

The operation of the present sewing machine system is controlled by a control device 70. As shown in FIG. 2, the control device 70 essentially consists of a computer including a central processing unit (CPU) 72, a read only memory (ROM) 74, a random access memory (RAM) 76 and a bus 78. The control device 70 includes an input interface 80 through which a keyboard 82 and an external storage device 82 are connected to the control device 70. The external storage device 82 has a plurality of sets of outline data stored therein each of which is representative of an outline of a predetermined area to be embroidered or filled with stitches. Each outline data includes a plurality of sets of position data each of which is representative of a corresponding one of a plurality of specific positions predetermined on the outline. Specifically, each position data consists of X and Y coordinates of the corresponding specific position in the X and Y coordinate system defined by the present sewing machine system. The specific positions on the outline cooperate with each other to constitute a polygon, and serve as the vertices defining the polygon. The outline may consist of the polygon, or a closed curve approximatated by the polygon. The present sewing machine system embroiders a predetermined area by alternately connecting with thread between a pair of opposed portions (described in detail later) of the outline.

The control device 70 further includes an output interface 100 through which a first, a second and a third drive circuit 104, 106, 108 are connected to the control device 70. The first, second and third drive circuits 104, 106, 108 serve for driving the main motor 26, X drive motor 58 and Y drive motor 64, respectively.

As shown in FIG. 3, the RAM 76 includes a number of memory areas **76*a*–76*k*together with a working area. The outline data area 76*a* stores sets of outline data (previously described), and the divided outline data area 76*b* stores sets of divided outline data (described later). The stitch position data area 76*c* stores stitch position data (described later), and the block data area 76*d* stores sets of block data (described later). The before-division stack area 76*e* stores sets of index data designating sets of outline data before being divided (described later), while the after-division stack area 76*f* stores sets of index data designating sets of outline data after being divided (described later). The maximum and minimum positions data area 76*g* stores sets of maximum and minimum positions data (described later), and the aid line data area 76*h* stores sets of aid line data (described later). The vertices stack area 76*i* stores sets of index data designating vertices (described later), and the blocks stack area 76*j* stores sets of index data designating blocks (described later). The divided outlines stack area 76*k* stores sets of index data designating sets of divided outline data (described later). The stacks 76*e*, 76*f*, 76*i*, 76*j*, 76*k*** are pushdown stacks.

The ROM 74 stores the stitch position data preparation program represented by the flow charts of FIGS. 4A, 4B, 5, 6, 7A, 7B, 8A, 8B, 9A, 9B, 10A, 10B and 10C.

There will be described the operation of the present embroidery sewing machine system for preparing stitch position data.

When the operator operates the keyboard 82 for keying in a stitch position data preparation command after applying electric power to the present system, the control of the CPU 72 begins with Step S1 of FIG. 4 (4A and 4B) to read in one or more sets of outline data from the external storage device 84, and store in the outline data area **76*a* of the RAM 76. Step S1 is followed by Step S2. Step S2 is the first division routine illustrated in detail in FIG. 5**, in which an outline represented by a currently designated set of outline data, or a polygon approximating the outline, is subjected to the first division. The first division is to reduce the current polygon to a plurality of sub-polygons so that each sub-polygon has no outward deflection vertex (described in detail later).

Figure 11:
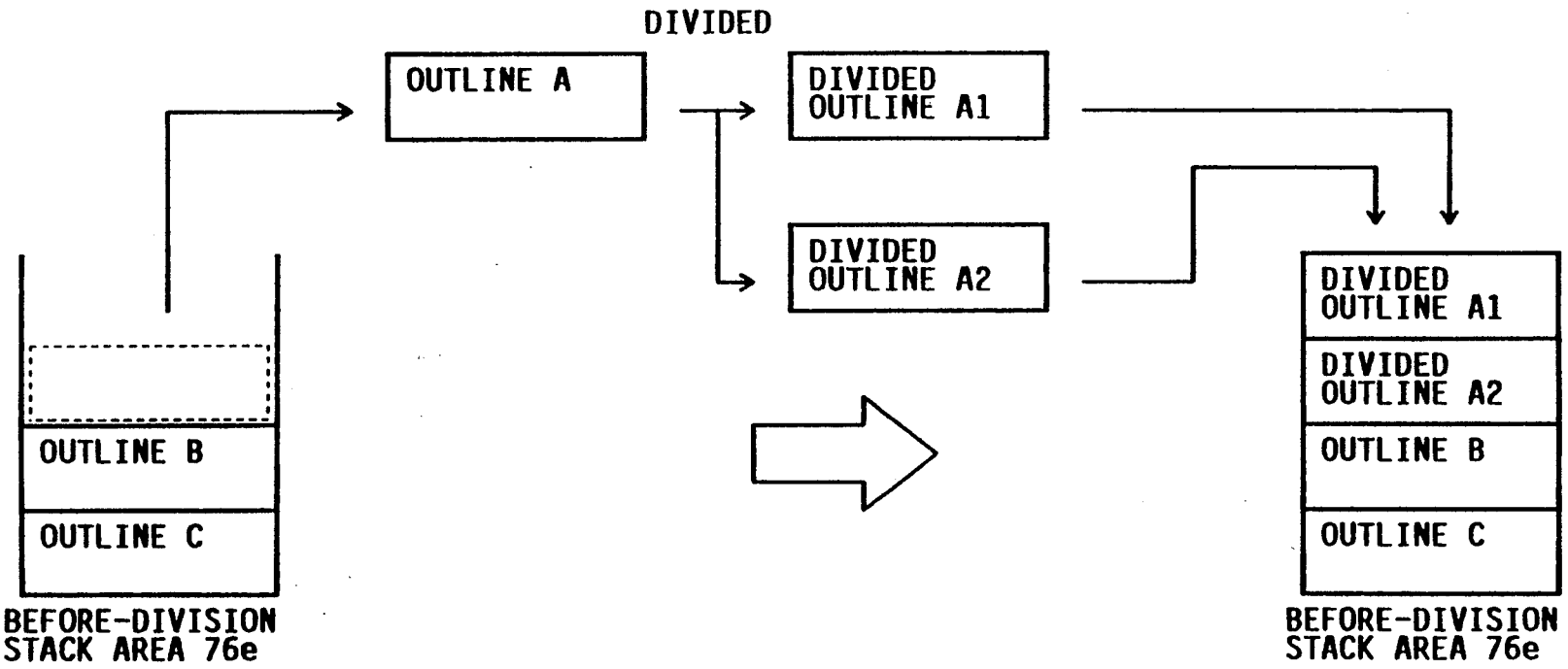
FIG. 11 is an illustrative view of a before-division stack area of the RAM of the computer.

Initially, in Step S13, one or more sets of index data each designating a corresponding one of the one or more sets of outline data stored in the outline data area 76a, are stored in the before-division stack area 76e. Step S13 is followed by Step S14 to judge whether or not the before-division stack area 76e is empty, namely, the before-division stack area 76e has no index data stored therein. Since the stitch position data preparation operation has just started, a negative judgement is made in Step S14. Therefore, the control proceeds with Step S15 to read in an index data from the before-division stack area 76e, as shown in FIG. 11, and specify an outline data designated by the index data as a current outline data to be processed in the current cycle. Step S14 is followed by Step 15. Step S15 is the routine illustrated in detail in FIG. 7 (7A and 7B), in which are determined a maximum and a minimum position of the current outline or polygon represented by the current outline data.

Figure 14:
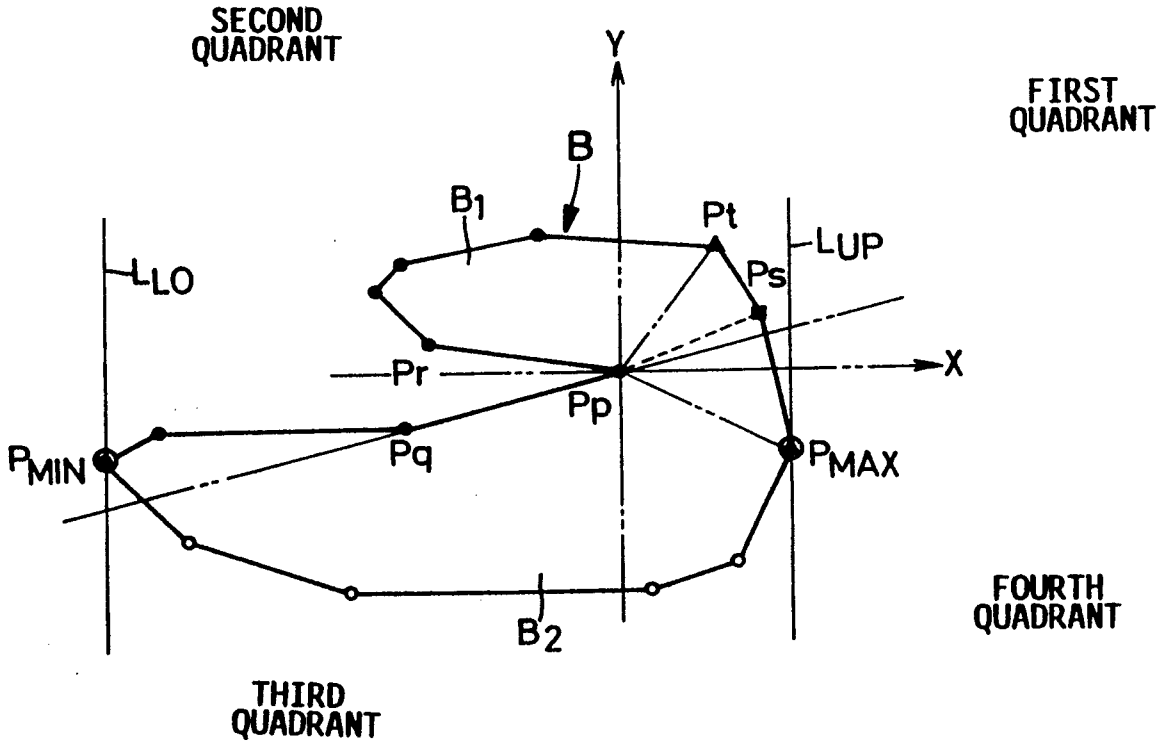
FIGS. 14 through 18 are views for explaining the routine of FIG. 8.

Initially, in Step S41, are determined a maximum and a minimum X coordinate value and a maximum and a minimum Y coordinate value of all the X and Y coordinate values of the vertices defining the current polygon, and are determined an X maximum vertex, $P_{xmax}$, having the maximum X coordinate value, an X minimum vertex, $P_{xmin}$, having the minimum X coordinate value, a Y maximum vertex, $P_{ymax}$, having the maximum Y coordinate value, and a Y minimum vertex, $P_{ymin}$, having the minimum Y coordinate value. Step S41 is followed by Step S42 to calculate a distance X between the X maximum and minimum vertices and a distance Y between the Y maximum and minimum vertices. Subsequently, in Step S43 it is judged whether or not the distance X is not smaller than the distance Y. If an affirmative judgement (YES) is made in Step S43, namely, if the distance X is greater than, or equal to, the distance Y, the control goes to Step S44 to determine the X maximum and minimum vertices as candidates for maximum and minimum positions, $P_{MAX}$ and $P_{MIN}$, of the current polygon, respectively. On the other hand, if a negative judgement (NO) is made in Step S43, namely, if the distance X is smaller than the distance Y, the control goes to Step S45 to determine the Y maximum and minimum vertices as candidates for the maximum and minimum positions $P_{MAX}$ and $P_{MIN}$, respectively. FIG. 14 shows a polygon A whose distance X is apparently greater than the distance Y thereof. Regarding the polygon A, therefore, the X maximum and minimum vertices are determined as the maximum and minimum positions candidates.

Subsequently, the control goes to Step S46 to determine a straight line passing the maximum and minimum positions candidates, as a candidate for a reference line of the current polygon. Further, in Step S46, are determined an upper limit line, $L_{LO}$, which passes the maximum position candidate and is perpendicular to the reference line candidate, and a lower limit line, $L_{UP}$, which passes the minimum position candidate and is perpendicular to the reference line candidate. Step S46 is followed by Step S47 to judge whether or not the current polygon has any vertex which does not fall within an area between the upper and lower limit lines. If a negative judgement is made, the maximum and minimum positions candidates are determined as the proper maximum and minimum positions of the current polygon. In this case, the control goes to Step S49 to store sets of data representative of those positions in the maximum and minimum positions data area 76g in such a manner that the sets of data stored are associated with the current polygon. On the other hand, if an affirmative judgement is made in Step S47, namely, the current polygon has one or more vertices located outside the area between the upper and lower limit lines, the control goes to Step S48 to select the most distant two vertices from the maximum and minimum positions candidates and the outside located one or more vertices, and determine the selected two vertices as the proper maximum and minimum positions of the current polygon. Step S48 is followed by Step S49. The direction of the reference line passing the proper maximum and minimum positions, is referred to as the longitudinal direction of the current polygon.

Figure 12:
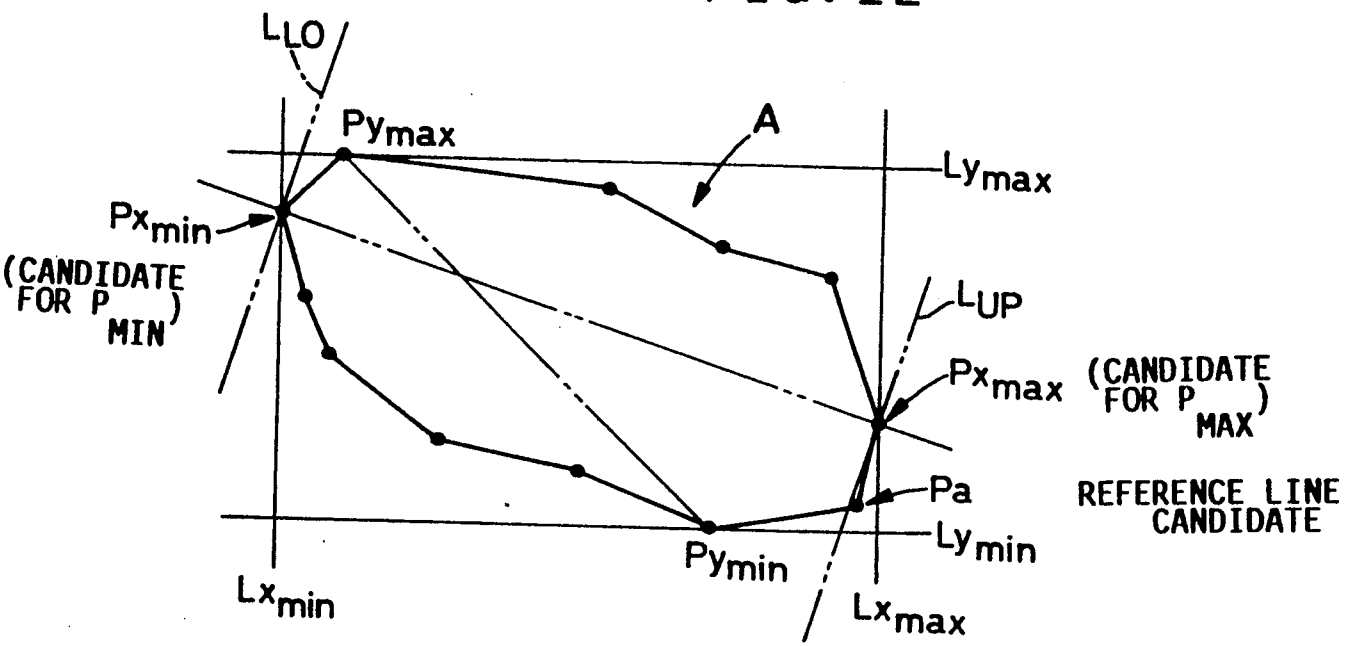
FIGS. 12 and 13 are views for explaining the routine of FIG. 7.
Figure 13:
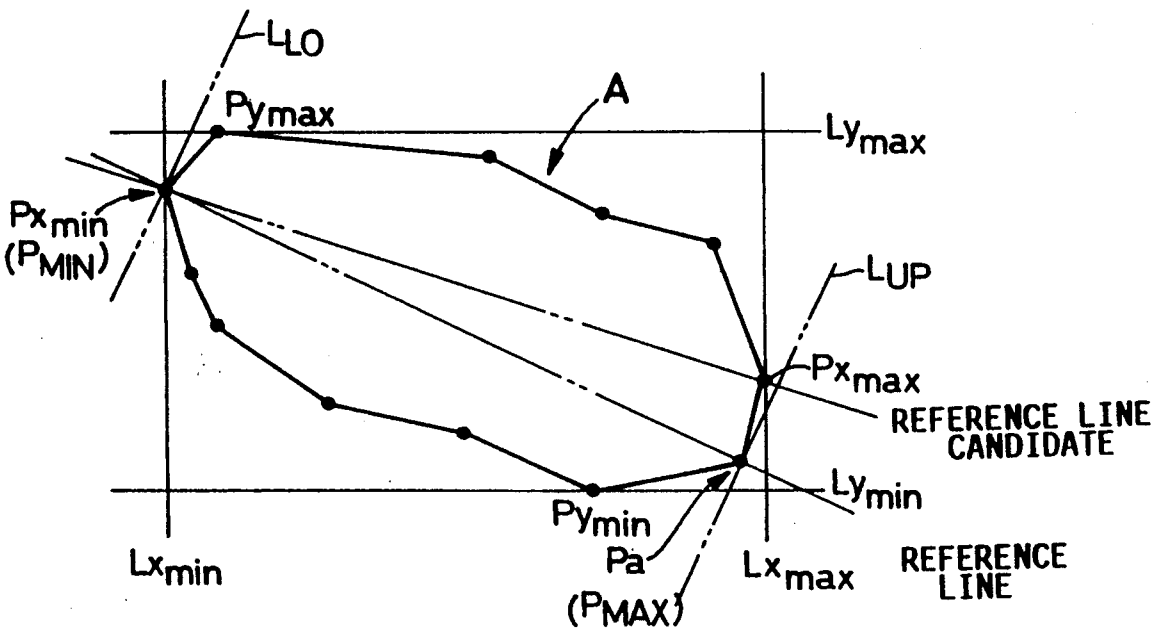

The polygon A shown in FIG. 12 has an outside vertex, Pa, located rightward from the upper limit line. Since a distance between the maximum position candidate and the vertex Pa is longer than the distance between the maximum and minimum positions candidates, the vertex Pa and the minimum position candidate are determined as the proper maximum and minimum positions, and a straight line passing the proper maximum and minimum positions is determined as the proper reference line of the polygon A, as illustrated in FIG. 13.

Figure 5:
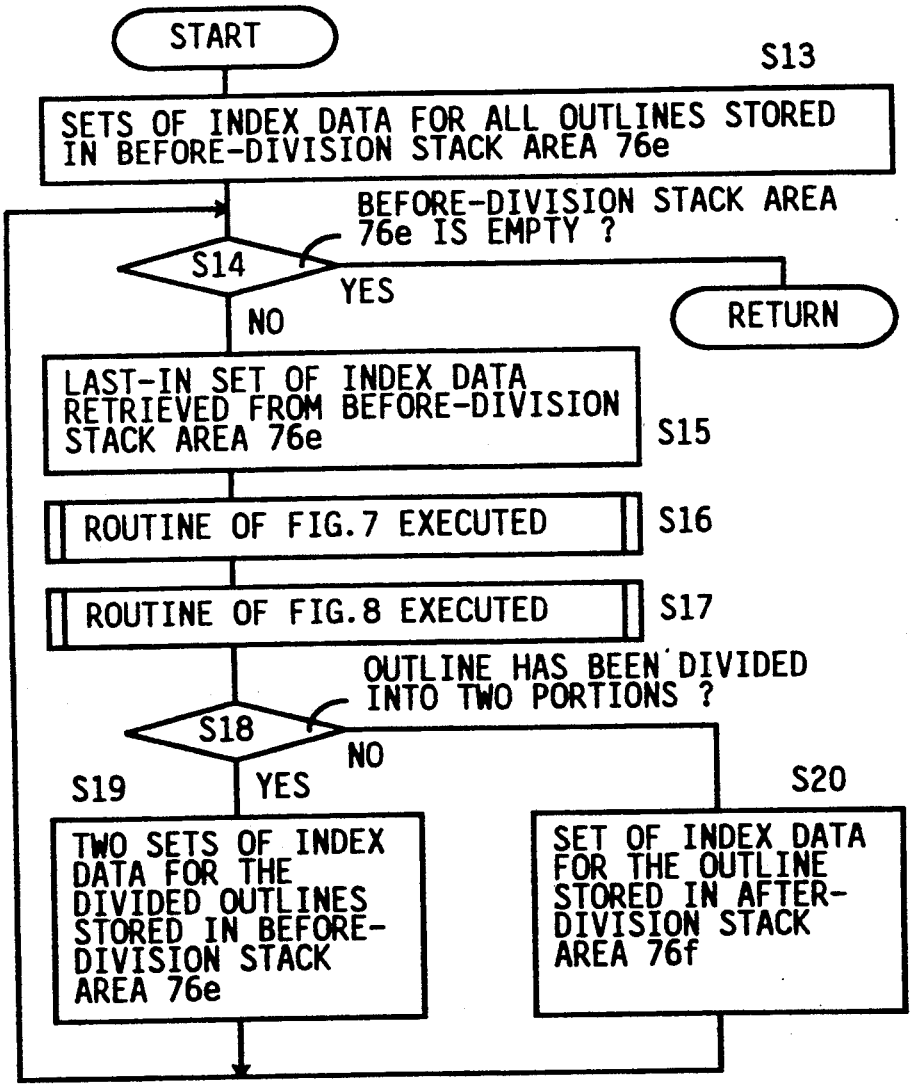
FIGS. 5, 6, 7A, 7B, 8A, 8B, 9A, 9B, 10A, 10B and 10C show flow charts illustrating the routines stored in the ROM which routines are associated with the stitching position data preparation routine.

After the proper maximum and minimum positions of the current polygon are determined in Step S15 of FIG. 5, the control goes to step S16, namely, the routine of FIG. 8 (8A and 8B).

In Step S71 of FIG. 8, data representative of the maximum and minimum positions $P_{MAX}$ and $P_{MIN}$ of the current polygon are read from the memory area 76g. Step S71 is followed by Step S72 to determine the longitudinal direction of the current polygon based on the read data. In addition, the current outline data is modified so as to rotate the current polygon in the X-Y coordinate system, so that the longitudinal direction of the polygon becomes parallel to the X axis. Further, the polygon is divided at the maximum and minimum vertices into a pair of opposed portions, and a vertex having a minimum Y coordinate value is determined with respect to each of the two portions of the polygon. One of the two polygon portions whose minimum Y coordinate is greater than that of the other polygon portion, is determined as an upper portion of the polygon, and the other portion is determined as a lower portion of the same.

Subsequently, in Step S73 a first flag, $F_U$, for the first division of the upper polygon portion, and a second flag, $F_L$, for the first division of the lower polygon portion, each are reset to zero. Step S73 is followed by Step S74 to judge whether or not the number of vertices of the upper polygon portion is not smaller than that of the lower polygon portion. In the case of polygons B, C, D, E and F shown in FIGS. 14–18, an affirmative judgement is made in Step 74 since the number of vertices of the upper portion is greater than that of the lower portion. Then, the control goes to Step S76 in which the first flag $F_U$ is set to one. And Step S76 is followed by Step S77 to check all the vertices on a currently checked polygon portion (e.g., upper portion) except for the vertices located at the maximum and minimum positions (hereinafter, referred to as the maximum and minimum vertices), in the order of location thereof on the current polygon portion from the minimum vertex to the maximum vertex, for finding a deflection vertex.

More specifically, it is checked whether or not a sign of a value obtained by subtracting an X coordinate value of a currently checked vertex from that of the following vertex that subsequently is checked, is different from a sign of a value obtained by subtracting an X coordinate value of the preceding vertex that has just been checked from that of the current vertex. If the checking result is affirmative, the current vertex is determined as a deflection vertex, but on the other hand if the checking result is negative the current vertex is determined as a non-deflection vertex.

If in Step S77 the current vertex of the current polygon portion is determined as a deflection vertex, the control goes to Step S78 to judge whether or not the current polygon portion to which the deflection vertex (i.e., current vertex) belongs, deflects outwardly at the deflection vertex. Specifically, in the case where the deflection vertex belongs to the upper polygon portion, it is judged whether or not the following vertex is located on the left-hand side of the deflection vertex as viewed in the direction of a vector starting at the preceding vertex and ending at the deflection vertex. On the other hand, in the case where the deflection vertex belongs to the lower polygon portion, it is judged whether or not the following vertex is located on the right-hand side of the deflection vertex as viewed in the direction of a vector starting at the preceding vertex and ending at the deflection vertex. In either case, if an affirmative judgement is made, the deflection vertex (i.e., current vertex) is determined as an outward deflection vertex. On the other hand, if a negative judgement is made, the deflection vertex is determined as an inward deflection vertex. As to the polygon B of FIG. 14, for example, a vertex $P_p$ is determined as an outward deflection vertex, namely, it is judged that the upper portion of the polygon B deflects outwardly at the vertex $P_p$.

Each time in Step 78 it is judged that the current polygon portion includes an outward deflection vertex, the control goes to Step S79 to determine the outward deflection vertex as a division base vertex. Step Step 79 is followed by Step S80 to determine a cooperative vertex which cooperates with the division base vertex to define a division line. Specifically, assuming that the X-Y coordinate system is parallel translated so that the origin thereof coincides with the division base vertex, are selected all the vertices that are located in one or two quadrants of the translated X-Y coordinate system which one or two quadrants contain a first straight half line starting at the division base vertex (i.e., origin) and extending parallel to a vector from the preceding vertex and the origin, or a second straight half line starting from the origin and extending parallel to a vector from the following vertex to the origin, and which vertices belong to the current polygon portion. In the case where a single vertex is selected, the single vertex is determined as the cooperative vertex. In the case where a plurality of vertices are selected, the nearest vertex to the division base vertex (i.e., origin) is determined as the cooperative vertex. Regarding the polygon B of FIG. 14, the above described first straight line is contained in the first quadrant of the translated X-Y coordinate system, and the second straight line is contained in the fourth quadrant. All the vertices that exist in the first and fourth quadrants are vertices $P_t$, $P_s$, $P_{MAX}$. Of those vertices the vertex $P_s$ is the nearest to the division base vertex $P_p$, and therefore the vertex $P_t$ is determined as the cooperative vertex for the the division base vertex $P_p$. In the case, however, where the first and second straight lines are contained in a single common quadrant and no appropriate vertex exists in that quadrant, the same operation as described above is effected on a quadrant opposite to the quadrant in question with respect to the X axis of the translated X-Y coordinate system.

A straight line passing the division base vertex and the cooperative vertex, serves as a division line. Step S80 is followed by Step S81 to judge whether or not the division line intersects the other polygon portion, i.e., the polygon portion opposed with respect to the maximum and minimum vertices to the current polygon portion. In a negative judgement is made in Step S81, namely, if the division line does not intersect the other polygon portion, the control goes to Step S82 to divide the current outline by the division line into two portions, and prepare two sets of divided outline data each representative of a corresponding one of the two divided outline portions. In addition, a third flag is set to one. As to the polygon B of FIG. 14, a segment $P_pP_s$ obtained by connecting between the vertices $P_p$ and $P_s$ is determined as the division line, and this division line does not intersect the lower polygon portion. Thus, the polygon B is divided into two sub-polygons $B_1$ and $B_2$. Step S82 is followed by Step 83 to modify the two sets of divided outline data so as to rotate the two divided outline portions and thereby restore to the initial angular position of the before-division outline. The divided outline data are stored in the divided outline data area **76*b*. Thus, one cycle of the routine of FIG. 8** is ended.

Figure 15:
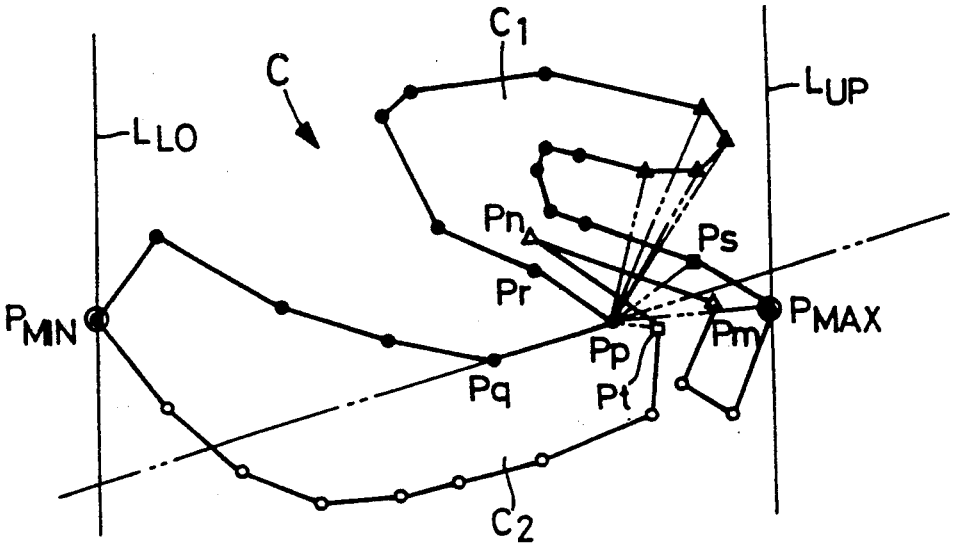
Figure 16:
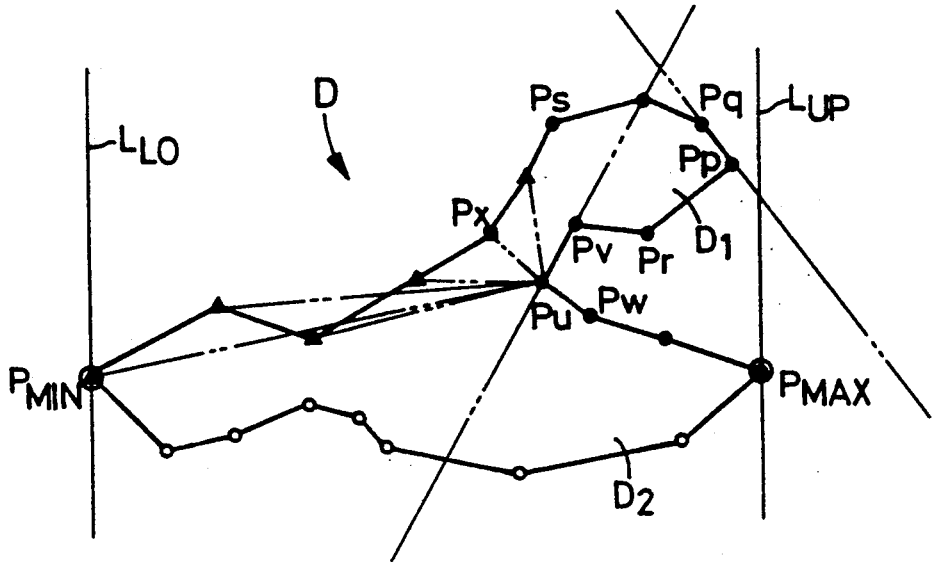
Figure 17:
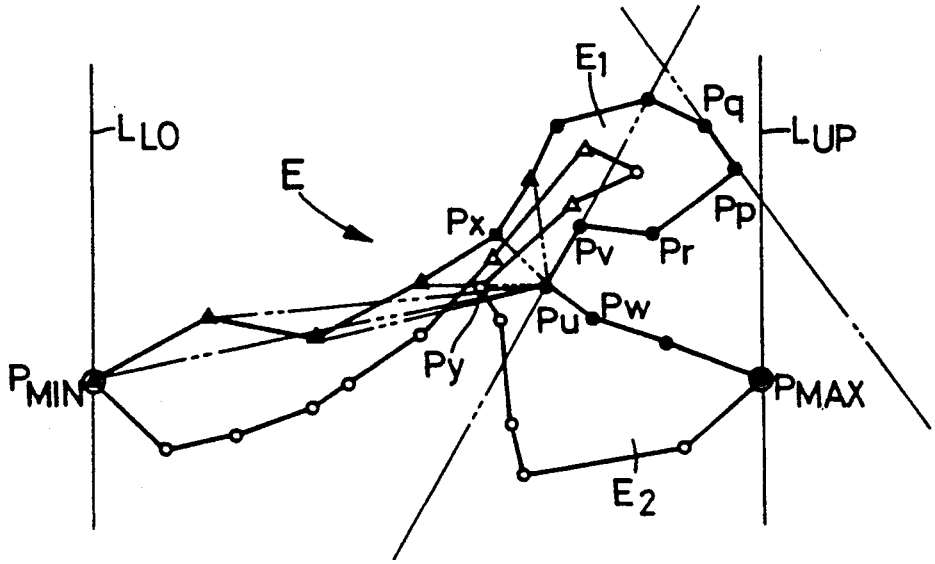
Figure 18:
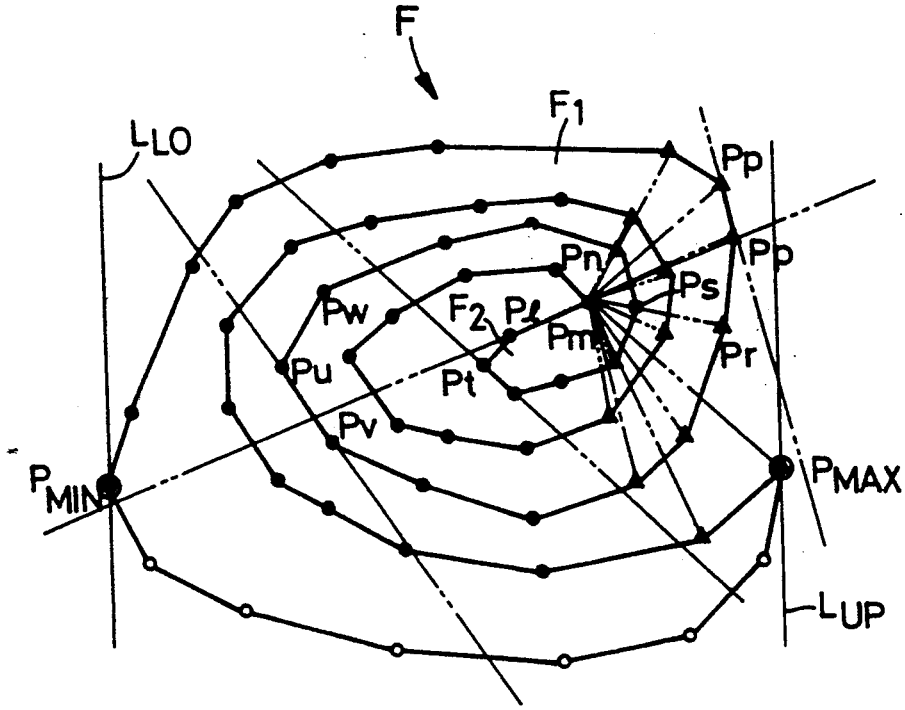
Figure 19:
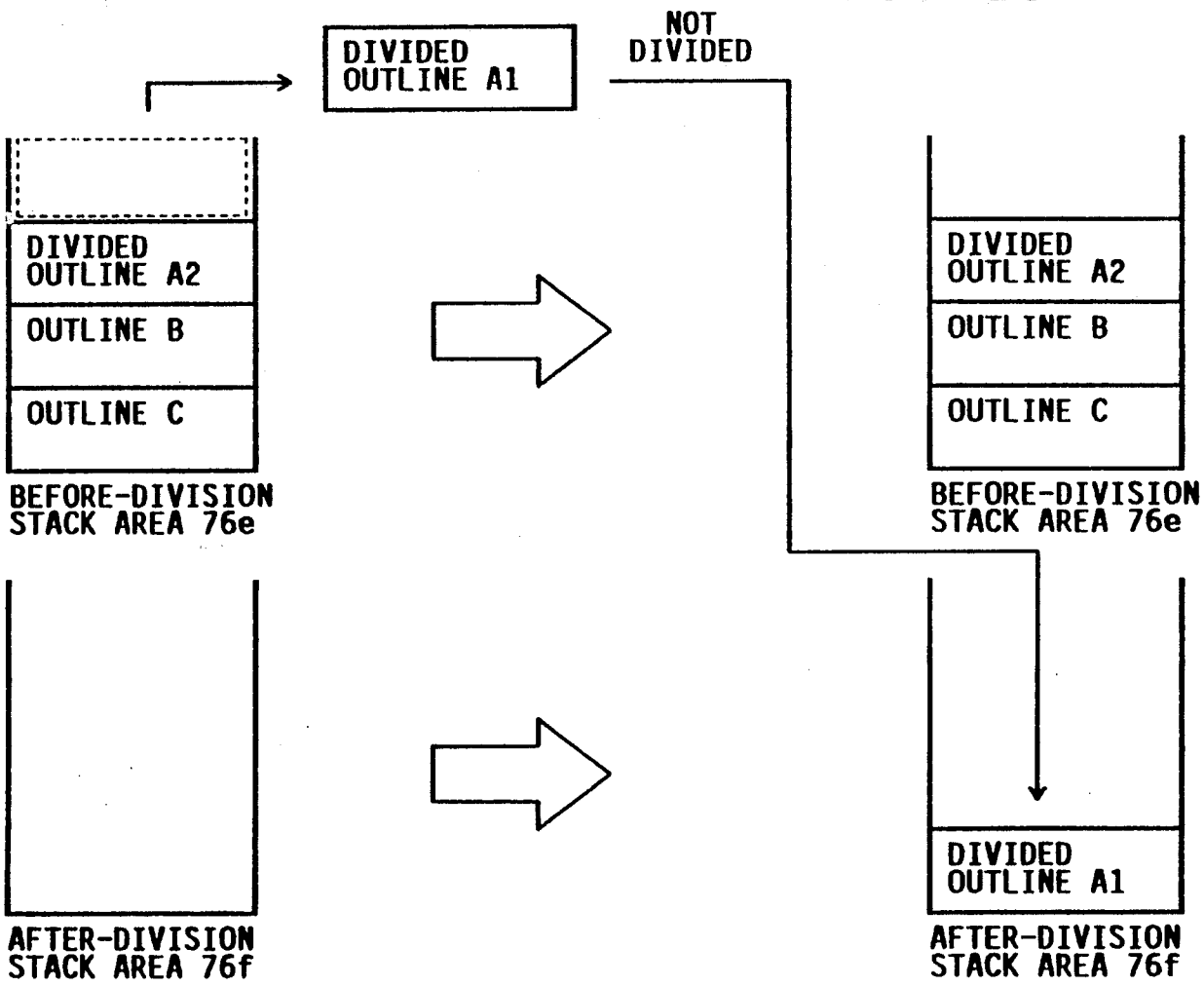
FIG. 19 is an illustrative view of a after-division stack area of the RAM of the computer.

Regarding the polygon C of FIG. 15, for example, a division line $P_pP_s$determined in Step S80 intersects the lower polygon portion, and an affirmative judgement is provided in Step S81. Then, the control goes to Step S84 to determine all the intersections of the division line and the other polygon portion different from the current polygon portion, select a side or straight segment on which is located the nearest intersection to the origin (i.e., division base vertex), and replace the cooperative vertex determined in Step S80 by one of the two vertices located at the opposite ends of the selected side which one vertex is the nearer to the origin. In addition, the division line determined in Step S80 is replaced by a straight line passing the origin and the corrected cooperative vertex. As to the polygon C of FIG. 15, the division line $P_pP_s$ intersects two sides $P_mP_n$ and $P_nP_t$ and the intersection of the division line and the side $P_nP_t$ is the nearer to the origin $P_p$ than the intersection of the division line and the side $P_mP_n$. Of the two vertices $P_n$ and $P_t$ of the side $P_nP_t$, the vertex $P_t$ is the nearer to the origin than the vertex $P_n$. Therefore, the vertex $P_t$ is determined as the cooperative vertex of the polygon C, and the polygon C is divided by the division line $P_pP_t$ into two sub-sections $C_1$ and $C_2$.

However, if in Step 78 a negative judgement is made, namely, if the deflection vertex found for the first time in the currently checked polygon portion is not an outward deflection vertex, i.e., an inward deflection vertex, the control goes back to Step S77 for checking the current polygon portion for another deflection vertex. This checking is effected with respect to the remainder of the current polygon portion which follows the inward deflection vertex. Steps S77 and S78 are repeated until an outward deflection vertex is found. Regarding each of the polygons D and E of FIGS. 16 and 17, vertices $P_p$ and $P_u$ are determined as a deflection vertex in Step S77 but the vertex $P_u$ is determined for the first time as an outward deflection vertex in Step S78. The vertex $P_u$ is determined as the division base vertex in Step S79. The cooperative vertices for the polygons D and E are $P_x$ and $P_y$, respectively. Further, regarding the polygon F of FIG. 18, vertices $P_p$, $P_u$, $P_s$, $P_t$ and $P_m$ are determined as a deflection vertex in this order but the vertex $P_m$ is determined for the first time as an outward deflection vertex. Therefore, the vertex $P_m$ is determined as the division base vertex, and the vertex $P_s$ is determined as the cooperative vertex. The polygon F is divided into two sub-polygons $F_1$ and $F_2$ by the segment $P_mP_s$ serving as the division line.

If the currently checked polygon portion has no outward deflection vertex, namely, if a negative judgement is provided in Step S77, the control goes to Step S85 to judge whether or not the first flag $F_U$ is in the state $F_U=1$ and the second flag $F_L$ is in the state $F_L=1$. That is, in this step it is identified whether or not the upper polygon portion has been checked and the lower polygon portion has not been checked. If an affirmative judgement is made in Step S85, the control goes to Step S87 and the following steps to effect the same operation as described above, for the lower polygon portion. Specifically, in Step S87 the second flag $F_L$ is set to one, and subsequently in Step S77 the lower polygon portion is checked for any deflection vertex. If an affirmative judgement is made in Step S77, Step S78 and the following steps are effected as previously described. On the other hand, if the lower polygon portion has no outward deflection vertex, namely, if a negative judgement is made in Step S77, the control goes to Step S85 to judge whether or not the flags $F_U$, $F_L$ are in the states $F_U=1$ and $F_L=1$, respectively. Since in this situation a negative judgement is provided in Step S85, the control goes to Step S86 to judge whether or not the flags $F_U$, $F_L$ are in the states $F_U=0$ and $F_L=1$, respectively. That is, in this step it is identified whether or not the lower polygon portion has been checked and the upper polygon portion has not been checked. Since in this situation the flags $F_U$, $F_L$ are in the situation $F_U=1$ and $F_L=1$, a negative judgement is made in Step S86, and the control returns to the flow chart of FIG. 5. Thus, one cycle of the routine of FIG. 8 (8A and 8B) is ended.

By the way, if the number of the vertices of the lower polygon portion is greater than that of the upper polygon portion, namely, if a negative judgement is provided in Step S74, the control goes to Step S87 and the following steps. If a negative judgement is made in Step S77, a negative judgement is made in Step S85 and an affirmative judgement is made in Step S86. Then, the control goes to Step S76 and the following steps to effect the same operation as described above, for the upper polygon portion.

The routine of FIG. 8, namely, Step S17 of FIG. 5 is followed by Step S18 to judge whether or not the current polygon has been divided. If Step S82 of FIG. 8 in which the polygon is divided is executed, the third flag, i.e., first division flag is set to one as previously described. Therefore, the judgement in Step S18 may be made by judging whether or not the third flag is in the state of one. If an affirmative judgement is made in Step S18, the control goes to Step S19 to store two sets of index data each designating a corresponding one of the two sets of divided-outline data stored in the divided-outline data area 76*b*, in the before-division stack area 76*e*, as shown in FIG. 11. On the other hand, if a negative judgement is made in Step S18, namely, if the current polygon needs no division, the index data designating the current outline data is stored in the after-division stack area 76*f*. Steps S17–S19 are repeated until the before-division stack area 76*e* becomes empty, namely, has no index data stored therein and an affirmative judgement is provided in Step S14.

A sub-polygon resulting from the first-time execution of the routine of FIG. 8 may further be divided by the subsequent one or more executions of the routine. It should therefore be understood that the "polygon" to be processed by the routine of FIG. 8 may be a sub-polygon obtained as a result of execution of the routine. This applies to the routine of FIG. 9 (described later).

Subsequently, the control returns to Step S3 of FIG. 4. Step S3 is the second division routine illustrated in detail in FIG. 6, in which a polygon is subjected to the second division. The second division is to divide a polygon into sub-polygons so that all segments obtained by connecting between each of the maximum and minimum vertices of each of the sub-polygons and each of the remainder vertices thereof, are contained therein. Since this routine is generally the same as the first division routine of FIG. 5, description of the common steps is omitted from the following.

First, in Step S21 all sets of index data stored in the after-division stack 76*f* are transferred to the before-division stack 76*e*. Steps S22, S23, S24 and S25 are executed for a polygon designated by each set of index data stored in the before-division stack 76*e*.

The routine of Step S25 is illustrated in FIG. 9 (9A and 9B). Initially, in Step S51 data representative of the maximum and minimum positions or vertices of a currently designated polygon is read from the maximum and minimum position data area 76*g*. The direction of a straight line passing the maximum and minimum vertices (i.e., reference line) is determined as a longitudinal direction of the current polygon. The current outline data representative of the current polygon is modified so as to rotate the polygon so that the longitudinal direction thereof becomes parallel to the X axis of the X-Y coordinate system. In Step S51 it is identified which one of a pair of opposed portions of the polygon which are opposed to each other with respect to the maximum and minimum vertices, is the upper or lower portion thereof.

Subsequently, in Step S52 sets of index data designating the vertices of the current polygon are stored in the vertices stack 76*i* such that, when the stored sets of index data are retrieved in the last-in first-out manner, first the sets of index data for the vertices of the upper polygon portion are retrieved beginning with the index data for a vertex which is by two vertices away from the minimum vertex and ending with the index data for the maximum vertex, and then the sets of index data for the vertices of the lower polygon portion are retrieved beginning with the index data for a vertex which is by two vertices away from the minimum vertex and ending with the index data for the maximum vertex. Step S52 is followed by Step S53 to judge whether or not the vertices stack are 76*i* is empty, namely, has no index data. In this situation, a negative judgement is provided in Step S53, and the control goes to Step S54 to retrieve a last-in set of index data from the vertices stack area 76*i* and effect the following steps to check a vertex designated by the retrieved index data In Step S55 a straight segment connecting the minimum vertex and the currently checked vertex is determined. Subsequently in Step S56 it is judged whether or not the segment is contained inside the current polygon. More specifically, in the case where a vertex on the upper polygon portion currently is checked, it is judged whether or not the preceding vertex of the currently checked vertex is located above the segment. In the case where a vertex of the lower polygon portion currently is checked, it is judged whether or not the preceding vertex of the currently checked vertex is located below the segment. If an affirmative judgement is made in Step S56, the control goes back to Step S53 to check the following vertex.

Figure 20:
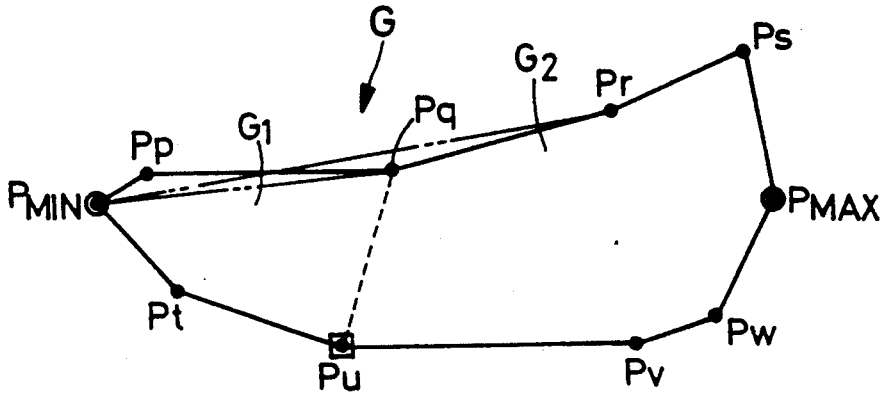
FIG. 20, is a view for explaining the routine of FIG. 9.
Figure 21:
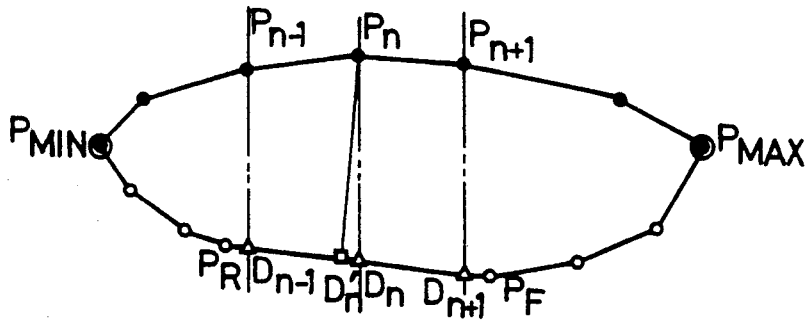
FIGS. 21 through 27 are views for explaining the routine of FIG. 10.
Figure 22:
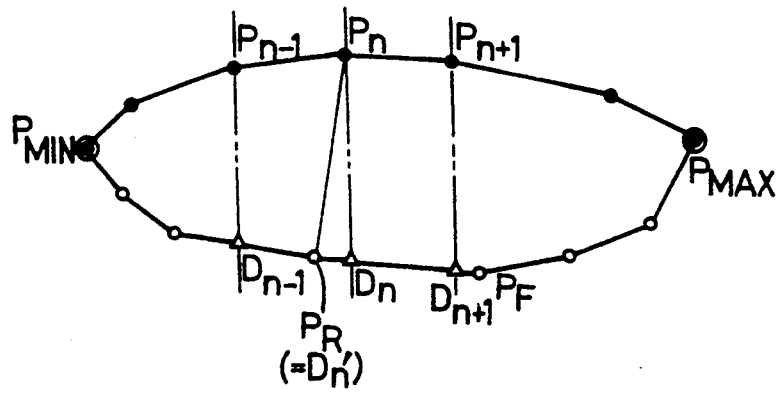
Figure 23:
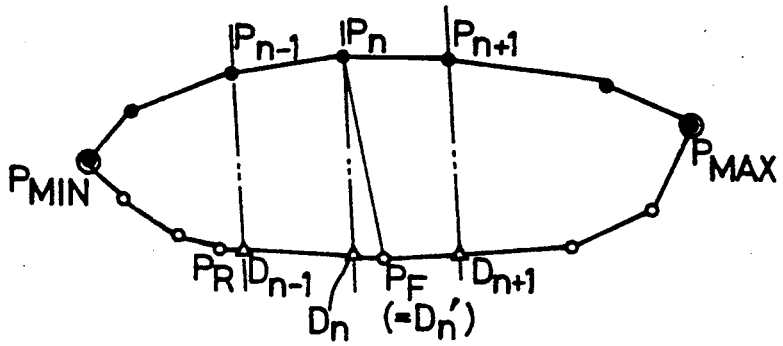

On the other hand, if a negative judgement is made in Step S56, the control goes to Step S57 to determine the preceding vertex of the currently checked vertex, as a division base vertex, and further determine a cooperative vertex which cooperate with the division base vertex to define a division line for dividing the current polygon into two sub-polygons. The cooperative vertex is defined as a vertex which is the nearest to the division base vertex of all the vertices of the current polygon (except the division base vertex and its two adjacent vertices on both sides thereof) that cooperate with the division base vertex to define segments contained in the current polygon. Subsequently, in Step S58 the current polygon is divided by the division line into two sub-polygons or two divided outlines, and two sets of divided-outline data each representative of a corresponding one of the two divided outlines or sub-polygons are prepared. The two sets of divided-outline data are modified so as to be free from the effect of the rotation of the before-division outline, and are stored in the divided outline data area 76*b*. In addition, a fourth flag is set to one. Regarding a polygon G shown in FIG. 20, for example, a segment $P_{MIN}P_q$ defined by a minimum vertex $P_{MIN}$ and a vertex $P_q$ is contained in the polygon G, but a segment $P_{MIN}P_q$ is not contained. Therefore, the vertex $P_q$ is determined as the division base vertex, and a vertex $P_u$ is determined as the cooperative vertex. Consequently, the polygon G is divided by the segment $P_qP_u$ into sub-polygons $G_1$ and $G_2$. Thus, one cycle of the routine of FIG. 9 (9A and 9B) is ended.

If an affirmative judgement is made in Step S53, namely, if it is judged that no segment is located outside the current polygon, the control goes to Step S59 to clear the content of the vertices stack area 76*i*, and prepare sets of index data designating the vertices of the current polygon and store in the vertices stack area 76*i*. In contrast to Step S52, however, the sets of index data are stored such that, when the stored sets of index data are retrieved on the last-in first-out manner, first the sets of index data for the vertices of the upper polygon portion are retrieved beginning with the index data for a vertex which is by two vertices away from the maximum vertex and ending with the index data of the minimum vertex, and then the sets of index data for the vertices of the lower polygon portion are retrieved beginning with the index data for a vertex which is by two vertices away from the maximum vertex and ending with the index data of the minimum vertex.

Step S59 is followed by Step S60 in which to judge whether or not the vertices stack area 76*i* is empty, namely, has no index data. In this situation, a negative judgement is provided in Step S60, and the control goes to Step S61 to retrieve a last-in set of index data from the vertices stack area 76*i* and execute the following steps to check a vertex designated by the retrieved index data.

Subsequently, in Step S62 a straight segment connecting the maximum vertex and the currently checked vertex is determined. Step S62 is followed by Step S56 to judge whether or not the segment is contained inside the current polygon. More specifically, in the case where the currently checked vertex belongs to the upper polygon portion, it is judged whether or not the preceding vertex of the currently checked vertex (as viewed from the maximum vertex to the minimum vertex) is located above the segment. In the case where the currently checked vertex is a vertex on the lower polygon portion, it is judged whether or not the preceding vertex of the currently checked vertex is located below the segment. If an affirmative judgement is made in Step S63, the control goes back to Step S60 to check the following vertex.

On the other hand, if a negative judgement is made in Step S60, the control goes to Step S64 to determine the preceding vertex of the currently checked vertex, as the division base vertex of the current polygon, and further determine the cooperative vertex for the current polygon, like Step S57. Subsequently, in Step S58 the current polygon is divided by the division line passing the division base and cooperative vertices, into two sub-polygons or two divided outlines. The two sets of divided-outline data are modified so as to be free from the effect of the rotation of the current outline before being divided, and are stored in the divided outline data area 76*b*.

Figure 6:
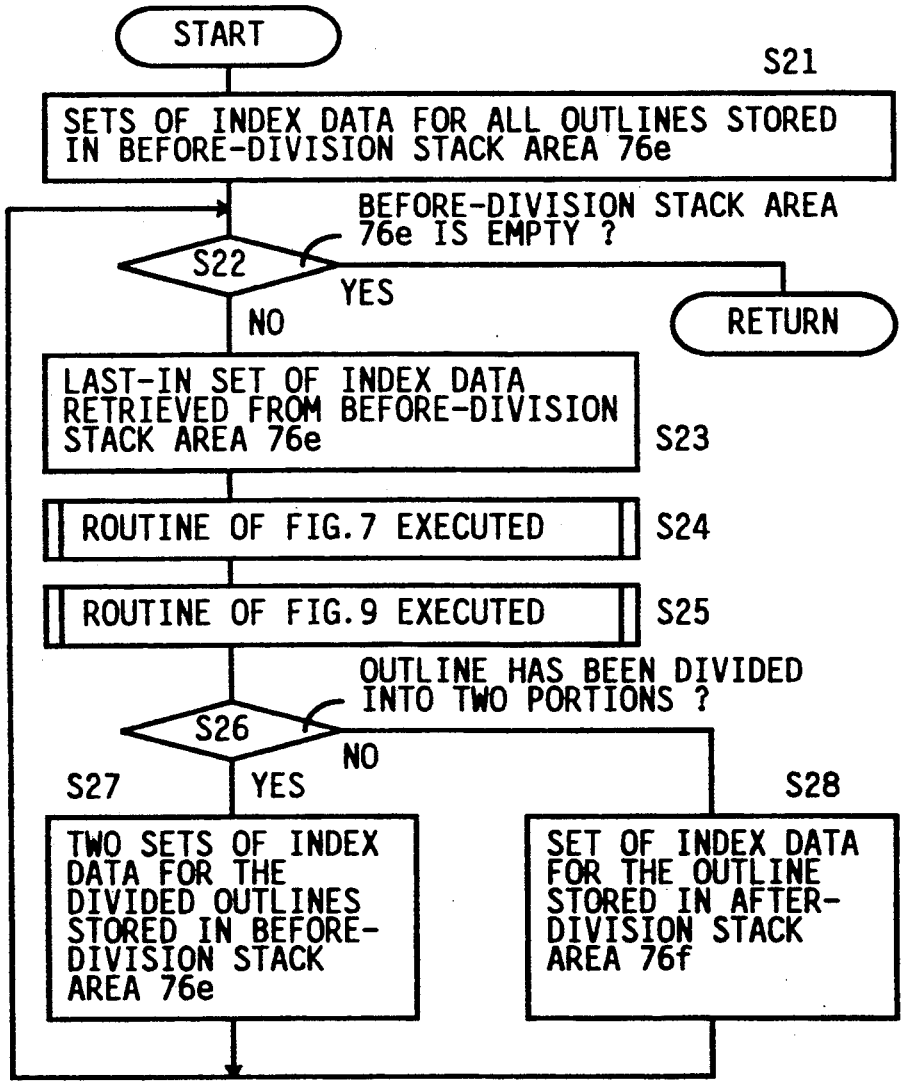
Figure 7A:
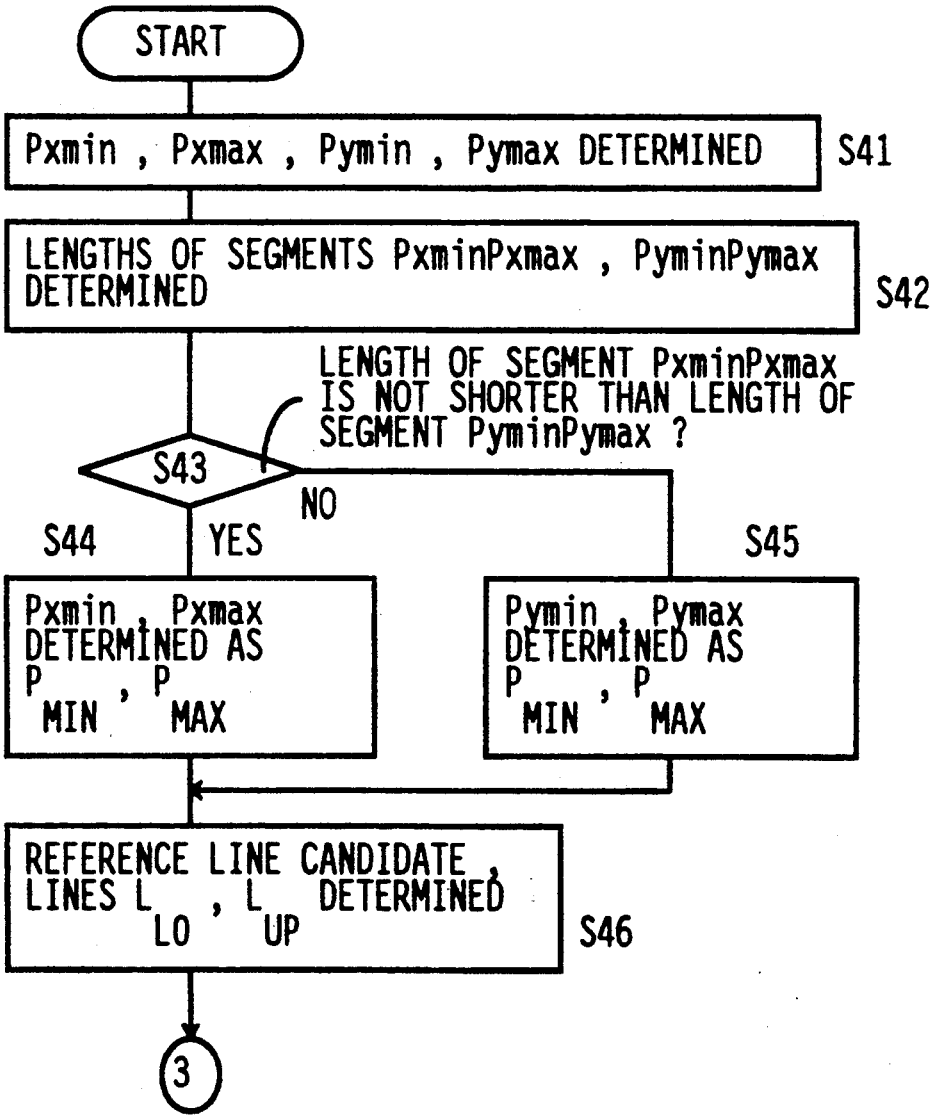
Figure 7B:
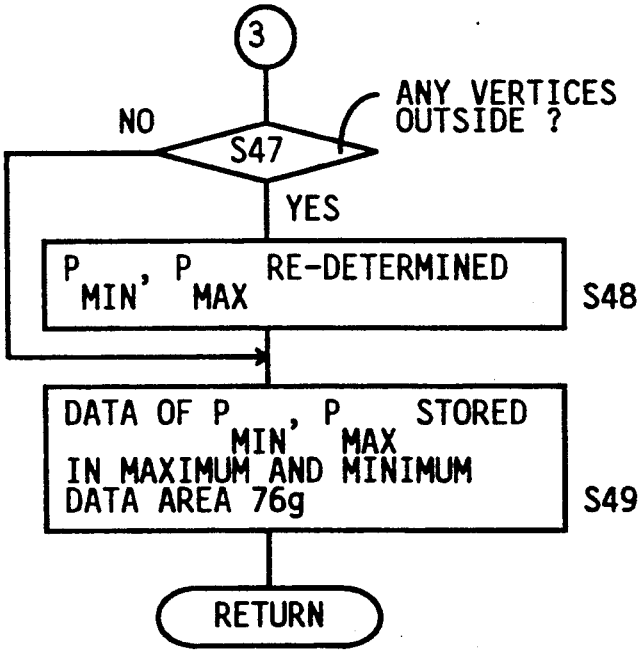
Figure 8A:
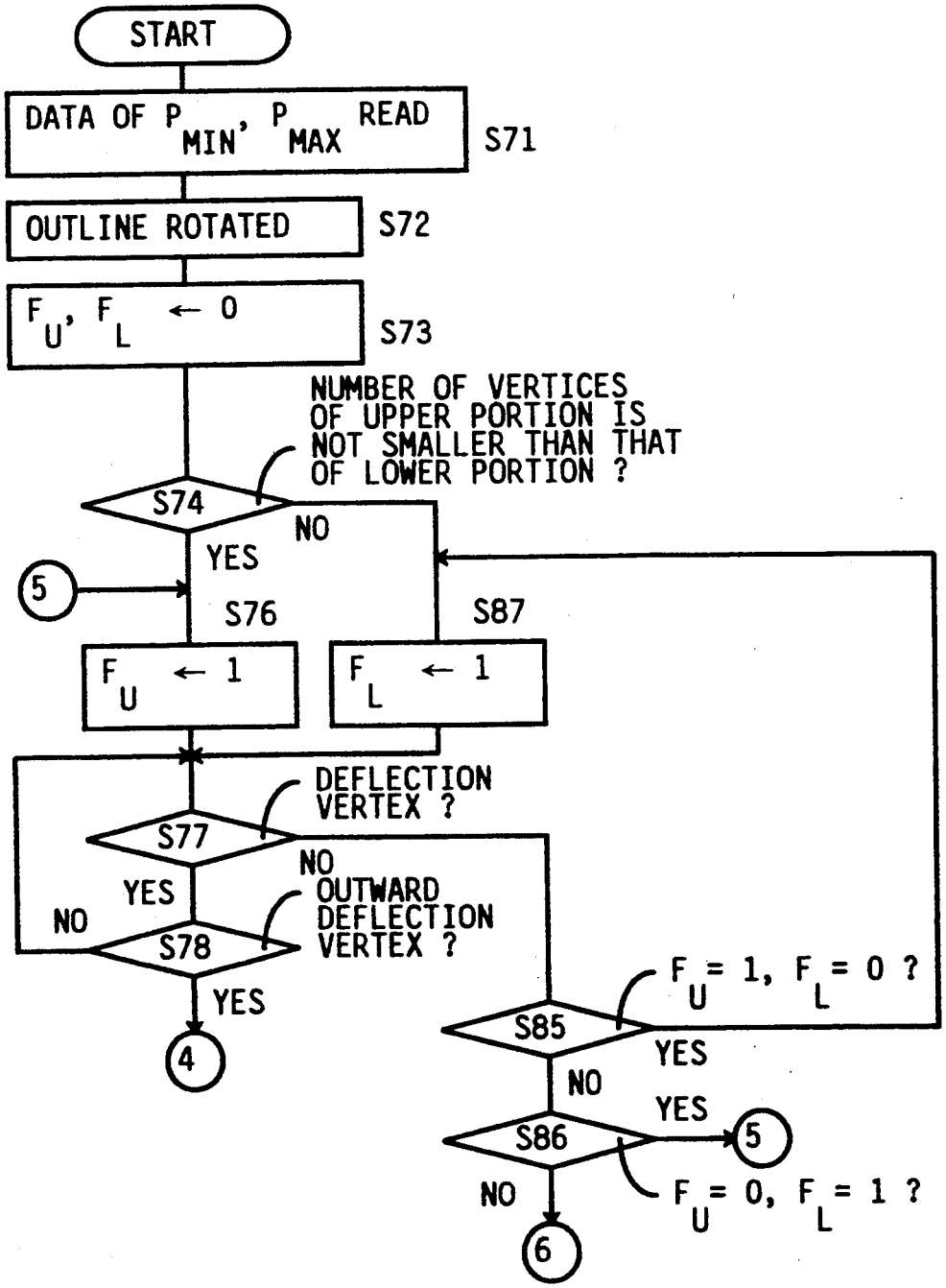
Figure 8B:
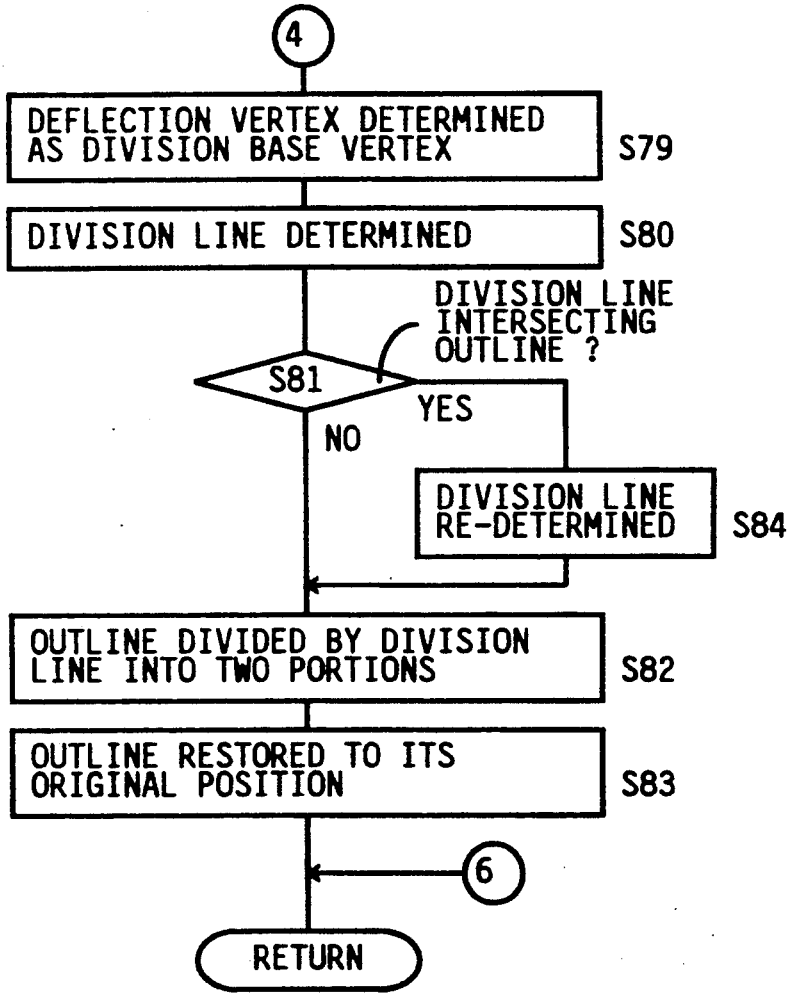
Figure 9A:
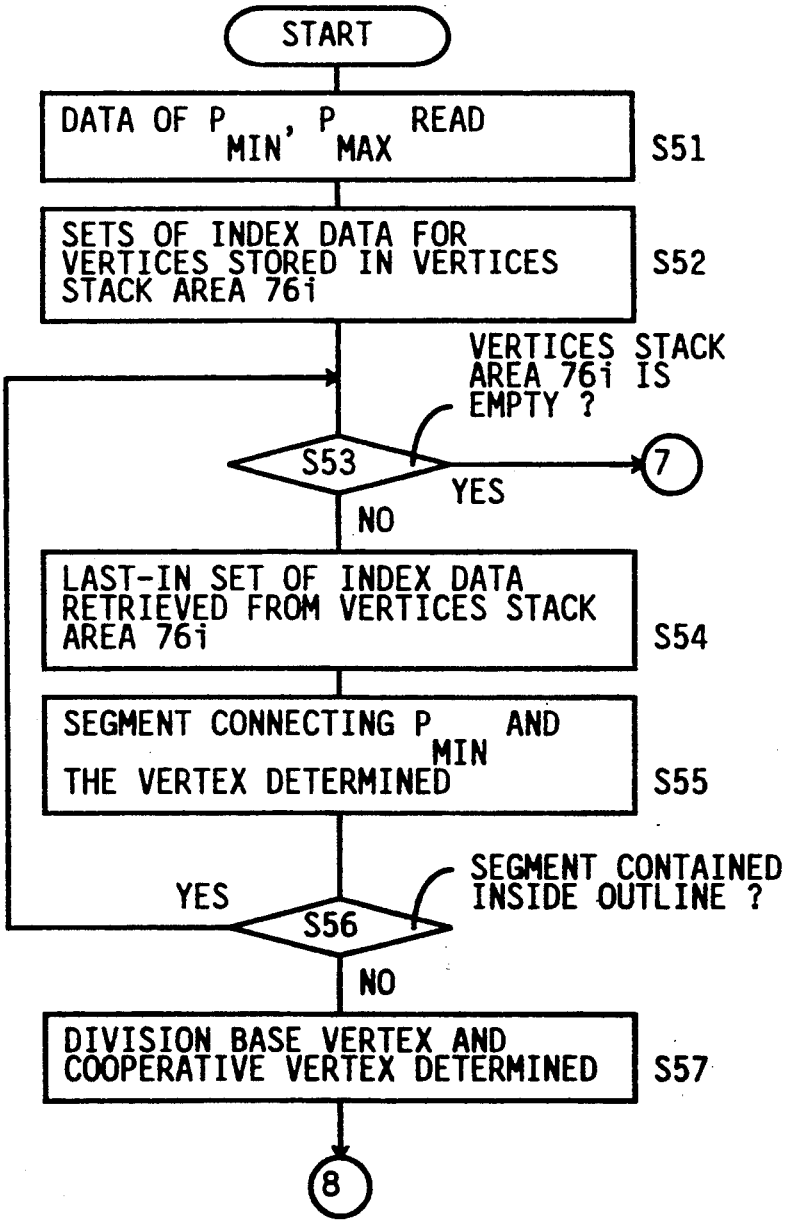
Figure 9B:
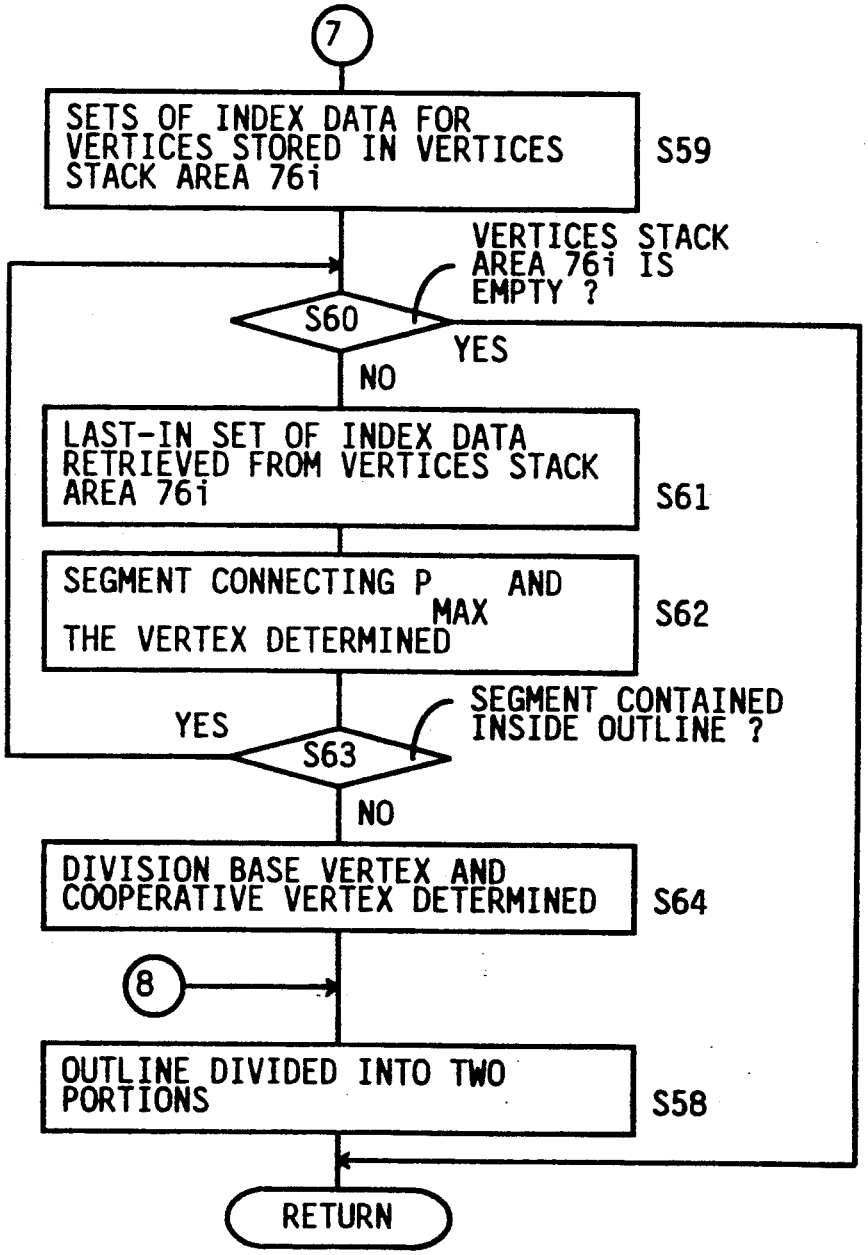
Figure 10A:
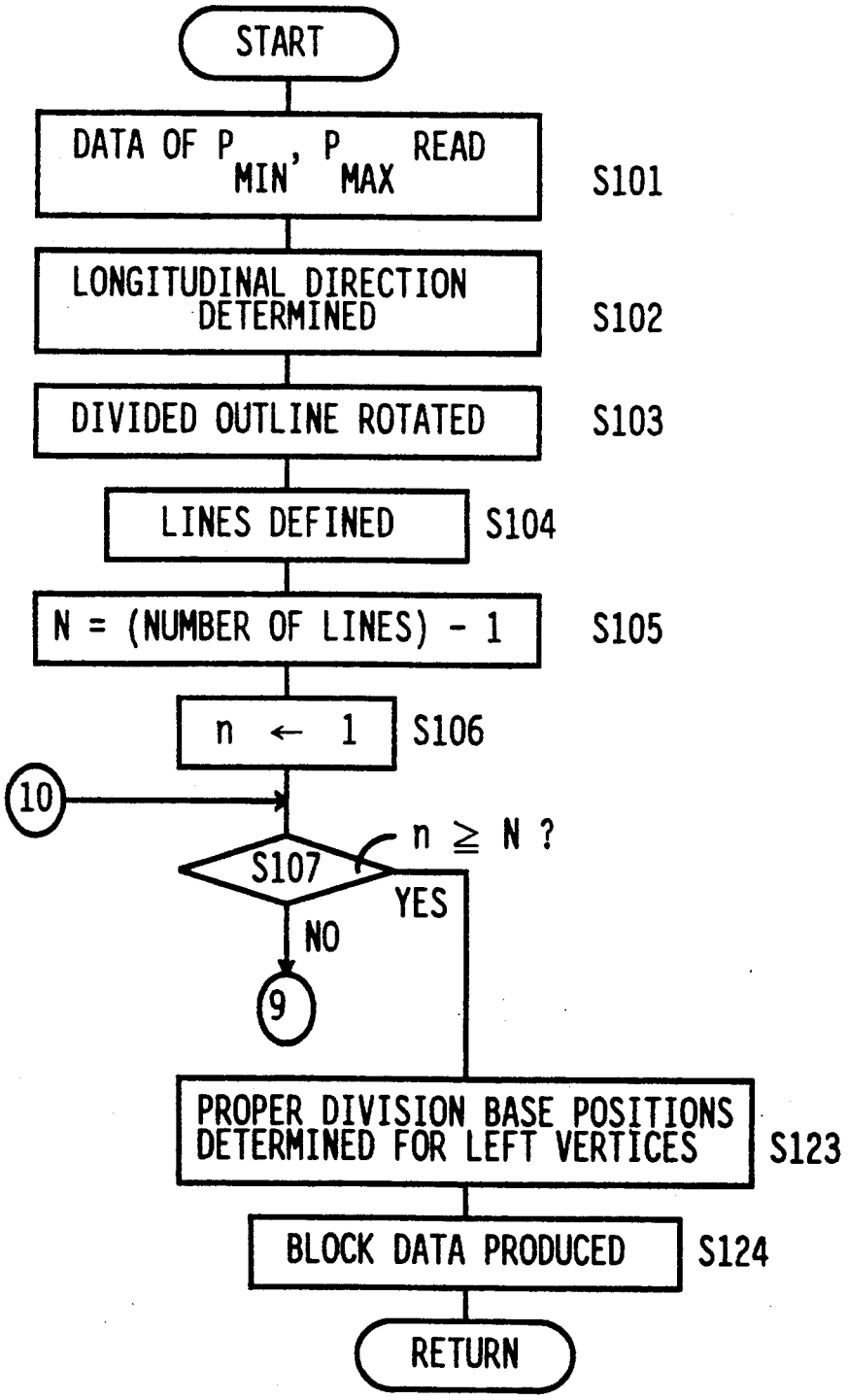
Figure 10B:
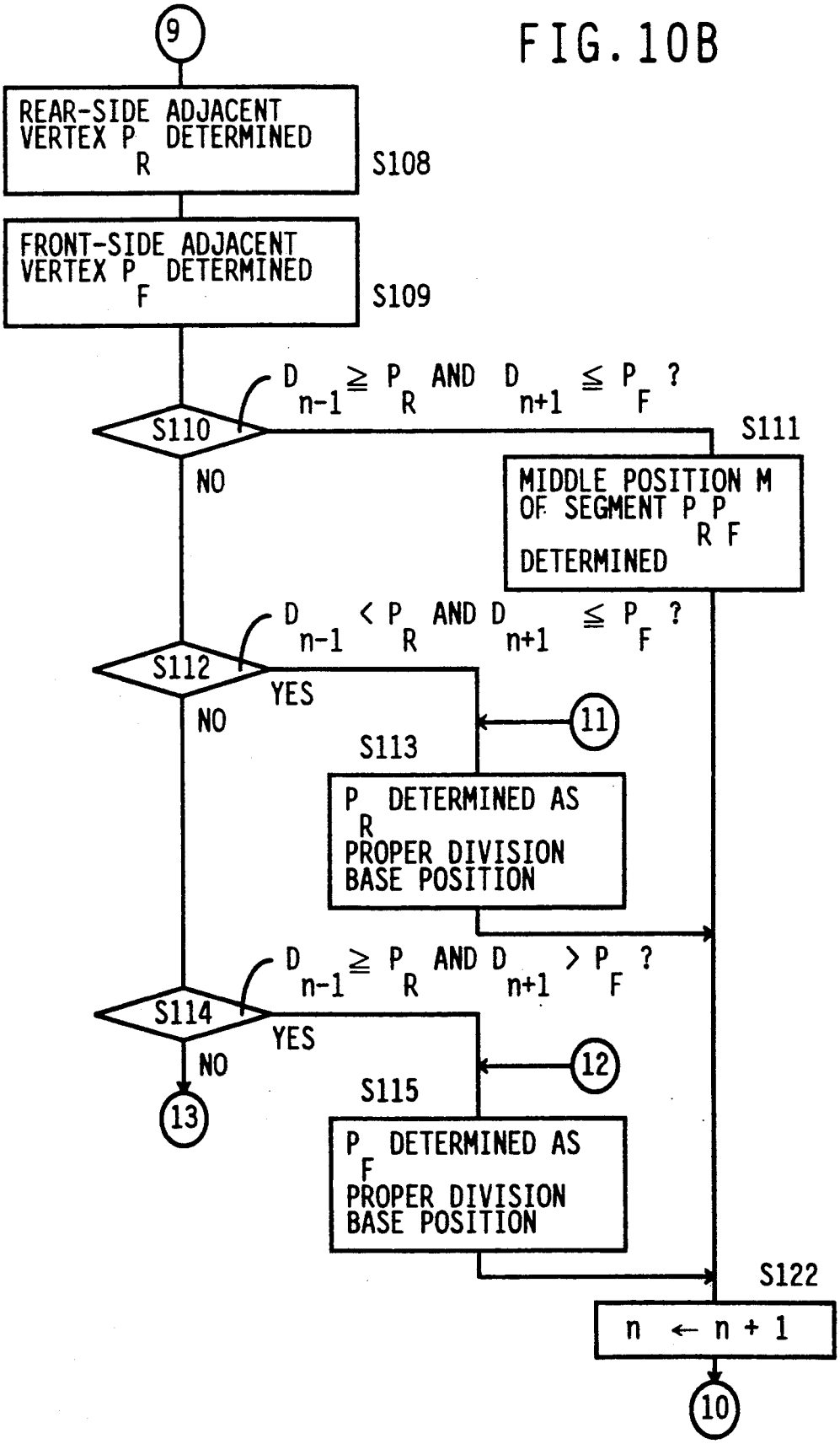
Figure 10C:
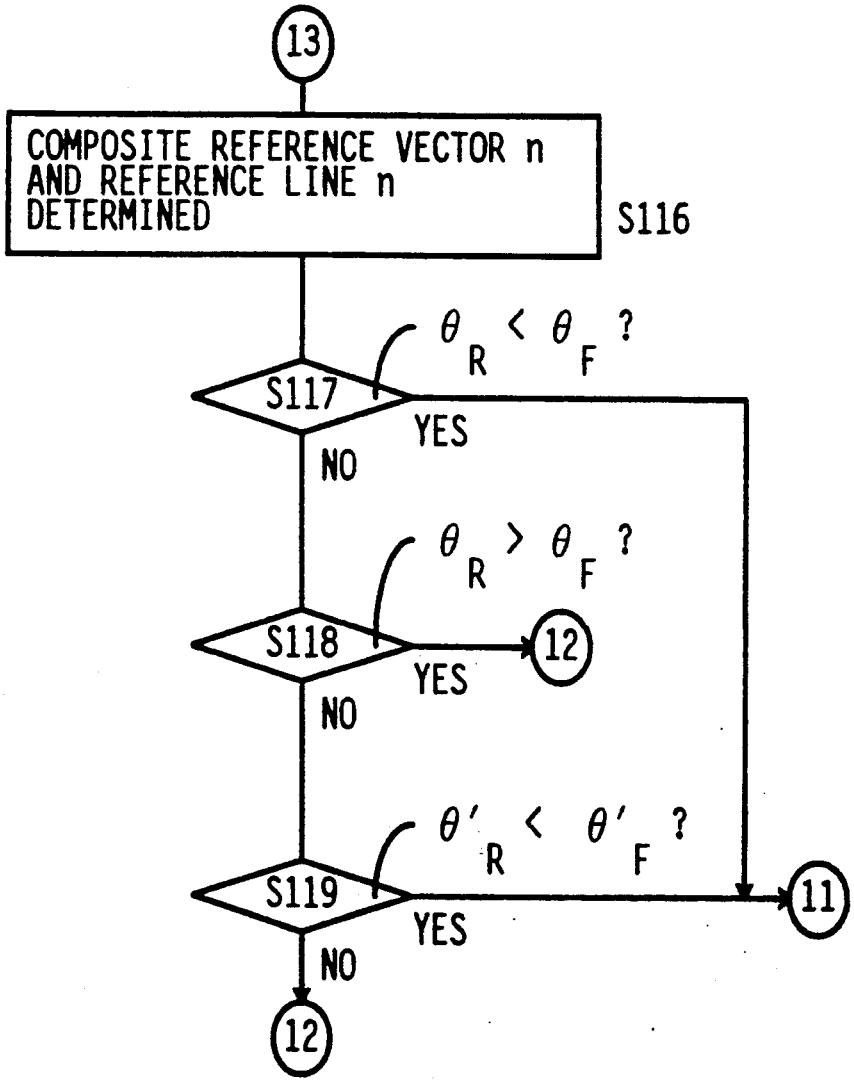

If an affirmative judgement is made in both Steps S53 and S60, namely, if it is found that no segment is located outside the current polygon, the current polygon is not divided, and the control returns to Step S26 of FIG. 6. Thus, one cycle of the routine of FIG. 9 (9A and 9B) is ended.

In Step S26 of FIG. 6 it is judged whether or not the current polygon has been divided in Step S25. If Step S58 of FIG. 9 in which the polygon is divided is executed, the fourth flag serving as the second division flag is set to one as previously described. Therefore, the judgement in Step S26 may be carried out by judging whether or not the fourth flag is in the state of one. If an affirmative judgement is made in Step S26, the control goes to Step S27 in which two sets of index data each designating a corresponding one of the two sets of divided-outline data stored in the divided-outline data area 76*b*, are stored in the before-division stack area 76*e*. On the other hand, if a negative judgement is made in Step S26, namely, if it is judged that the current polygon needs no division, the control goes to Step S28 to store the index data designating the current outline data in the after-division stack area 76*f*. Steps S22–S28 are repeated until the before-division stack area 76*e* becomes empty, and an affirmative judgement is provided in Step S22. It is noted that a sub-polygon resulting from the first-time execution of the routine of FIG. 9 may further be divided by the subsequent one or more executions of the routine, indicated previously.

Subsequently, in Step S4 of FIG. 4 all sets of index data stored in the after-division stack area 76*f* are transferred to the divided outline stack area 76*k*. The sets of index data stored in the area 76*k* may contain a set of index data designating an outline data which has never been divided even after the execution of Steps S2 and S3. Step S4 is followed by Step S5 in which it is judged whether or not the divided outline stack area 76*k* is empty. In this situation, a negative judgement is made in Step S5, and subsequently in Step S6 a last-in set of index data is retrieved from the area 76*k* and a divided outline data designated by the retrieved index data (hereinafter, abbreviated as the current outline data) is subjected to Step S7 (7A and 7B) in which the current outline represented by the current outline data is divided into a plurality of blocks. The routine of Step S7 is illustrated in detail in FIG. 10 (10A, 10B and 10C).

In the routine of FIG. 10, the control begins with Step S101 in which data representative of the maximum and minimum vertices of the current outline, are read from the maximum and minimum positions data area 76g. Step S101 is followed by Step S102 in which the longitudinal direction of the current outline is determined as a direction of a straight line passing the maximum and minimum vertices of the outline. Subsequently, in Step S103 the current outline data is modified so as to rotate the current outline so that the longitudinal direction thereof becomes parallel to the X axis of the X-Y coordinate system.

Subsequently, in Step S104 it is judged whether or not the number of vertices on the upper outline portion is not smaller than that of the lower outline portion. If an affirmative judgement is made the upper portion is selected, while if a negative judgement is made the lower portion is selected. With respect to each of the vertices of the selected upper or lower portion, is defined a straight first aid line which passes the each vertex and is perpendicular to the longitudinal direction of the current outline, namely, parallel to the Y axis of the X-Y coordinate system. An intersection of each of the first aid lines and one of the upper and lower outline portions which one portion is opposed to the other portion to which the vertex associated with the each first aid line belongs, is determined as a candidate for a division base position which cooperates with the associated vertex to define a straight division line. Sets of line data each representative of a corresponding one of the first aid lines and the associated vertex and division base position candidate (hereinafter, abbreviated to the "candidate"), are stored in the line data area 76h. It is noted that the minimum vertex serves as the vertex and candidate associated with a first aid line numbered zero passing it, while the maximum vertex serves as the vertex and candidate associated with a first aid line numbered N passing it.

FIGS. 21 through 27 show polygons each of which has the feature that the number of vertices of the upper portion thereof is greater than that of the lower portion thereof. In the figures, symbol $P_n$ denotes a vertex numbered n, while symbol $D_n$ denotes a division base position candidate numbered n. FIG. 28 shows an example of line data.

Step S104 is followed by Step S105 to store the number N obtained by subtracting one from the number of the first aid lines provided with respect to the selected upper or lower portion of the current outline, in an appropriate storage area. Subsequently, in Step S106 the content, n, of a counter representative of the number of a currently designated first aid line, is set to one. That is, the control executes Step S107 for a first aid line numbered one. In Step S107 it is judged whether or not the count n is not smaller than the number N. In this situation, a negative judgement is provided, and the control goes to Step S108 to determine a rear-side adjacent vertex (indicated at $P_R$ in the figures) whose X coordinate value is the greatest of all the vertices that are on one of the outline portions different from the other outline portion to which the vertex n associated with the first aid line n belongs and whose X coordinate values are smaller than the X coordinate value of the candidate n. Step S108 is followed by Step S109 to determine a front-side adjacent vertex (indicated at $P_F$) whose X coordinate value is the smallest of all the vertices that are on the one outline portion different from the other outline portion to which the vertex n associated with the first aid line n belongs and whose X coordinate values are greater than the X coordinate value of the candidate n.

Subsequently, in Step S110 it is judged whether or not the X coordinate value of the rear-side adjacent vertex is not greater than that of the candidate (n−1) and the X coordinate value of the front-side adjacent vertex is not smaller than that of the candidate (n+1). That is, it is judged whether or not the rear-side adjacent vertex is not located between the candidates n and (n−1) and the front-side adjacent vertex is not located between the candidates n and (n+1). Regarding the example of FIG. 21, an affirmative judgement is made, and the control goes to Step S111 to determine as a proper division base position (indicated at $D'_n$ in the figures) a middle point of a straight segment connecting the rear- and front-side adjacent vertices. On the other hand, If a negative judgement is made in Step S110, the control goes to Step S112 to judge whether or not the X coordinate value of the rear-side adjacent vertex is greater than that of the candidate (n−1) and the X coordinate value of the front-side adjacent vertex is not smaller than that of the candidate (n+1). That is, it is judged whether or not the rear-side adjacent vertex is located between the candidates n and (n−1) and the front-side adjacent vertex is not located between the candidates n and (n+1). Regarding the example of FIG. 22, an affirmative judgement is made, and the control goes to Step S113 to determine the rear-side adjacent vertex as the proper division base position. If a negative judgement is made in Step S112, the control goes to Step S114 to judge whether or not the X coordinate value of the rear-side adjacent vertex is not greater than that of the candidate (n−1) and the X coordinate value of the front-side adjacent vertex is smaller than that of the candidate (n+1). That is, it is judged whether or not the rear-side adjacent vertex is not located between the candidates n and (n−1) and the front-side adjacent vertex is located between the candidates n and (n+1). Regarding the example of FIG. 23, an affirmative judgement is made, and the control goes to Step S115 to determine the front-side adjacent vertex as the proper division base position.

Figure 24:
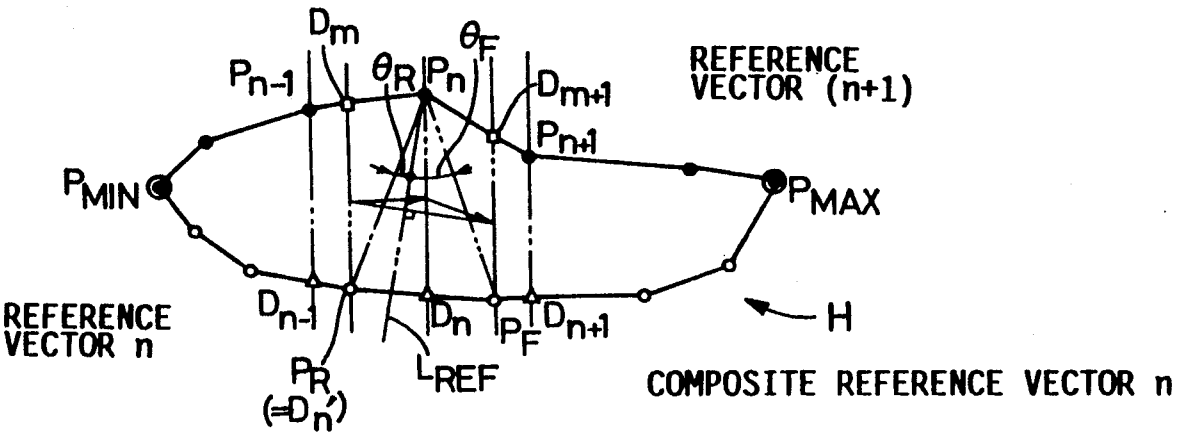
Figure 25:
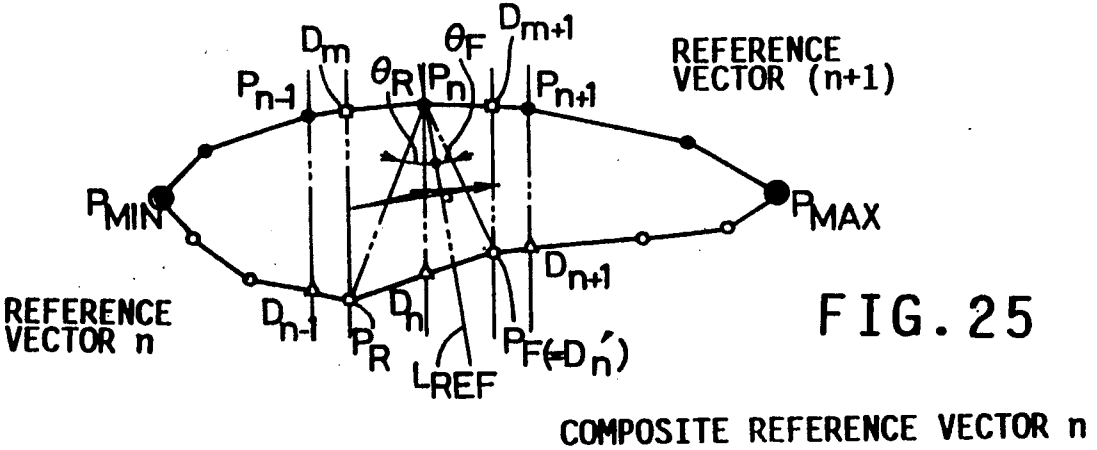
Figure 26:
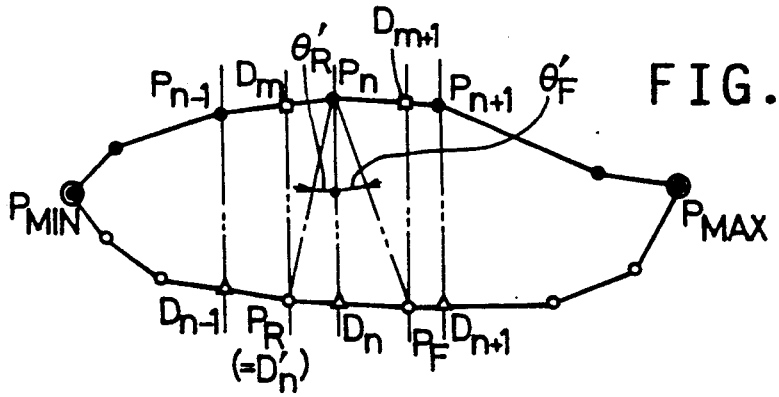
Figure 27:
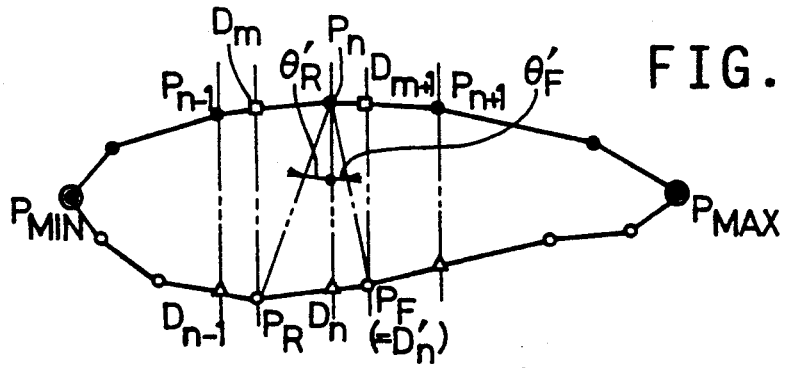

In the case where the rear-side adjacent vertex is located between the candidates n and (n−1) and the front-side adjacent vertex is located between the candidates n and (n+1), a negative judgement is made in Step S114, and the control goes to Step S116 in which, as shown in FIG. 24, are defined two straight second aid lines which are parallel to the Y axis of the X-Y coordinate system and pass the rear- and front-side adjacent vertices, respectively, and are determined two intersections (indicated at $D_m$, $D_{m+1}$ in the figures) of the second aid lines and the upper or lower outline portion to which the vertex n belongs. Consequently, two blocks are obtained on both sides of the first aid line n. These two blocks are equivalent to two blocks n, (n+1) which are obtained on both sides of a straight third aid line n by defining, with respect to each of the vertices on the current outline, a straight third aid line which passes the each vertex and is parallel to the Y axis. Each of the blocks is enveloped by four segments two of which are defined by corresponding two of the third aid lines and the other two of which are defined by corresponding two of the segments which result from the division of the outline by the third aid lines. The two third aid lines of each block are opposed to each other in the direction of the X axis of the X-Y coordinate system, while the two segments of the each block are opposed to each other in the direction of the Y axis. In addition, in Step S116, with respect to the block n, a reference vector n is determined as follows: First, a first vector is determined which starts at one of opposite ends of one of the opposed two segments and ends at the other end of the one segment, a second vector is determined which starts at one of opposite ends of the other of the opposed two segments which one end is opposed to the one end of the one segment and ends at the other end of the other segment, and the reference vector n which starts at a position on a third aid line numbered (n−1), extends in a direction of a vector obtained by addition of the first and second vectors, and ends at a position on a third aid line numbered n. The end position of the reference vector n on the third aid line n serves simultaneously as the start position of a reference vector (n+1). In the present embodiment, the minimum vertex serves as the start position of a reference vector numbered one, while the maximum vertex serves as the end position of a reference vector N. The start and end position on the third aid line n is referred to as a reference position n of the third aid line n. It is noted that the reference position n is a middle point of a segment of the third straight line n which segment is inside the current outline. Further, a composite reference vector n is obtained by addition of the reference vectors n and (n+1). Finally, a reference line n (indicated at $L_{REF}$ in the figures) is determined which is perpendicular to the composite reference vector n and passes the vertex n.

Of the blocks obtained inside the current outline, the two blocks to which the minimum and maximum vertices belong are a triangle. In the present embodiment, the minimum vertex serves as the start ends of the first and second vectors for the block to which the minimum block belongs, while the maximum vertex serves as the end ends of the first and second vectors of the block to which the maximum block belongs.

Step S116 is followed by Step S117 to determine an angle $\theta_R$ contained by the reference line n and a straight rear-side adjacent line passing the vertex n and the rear-side adjacent vertex, and an angle $\theta_F$ contained by the reference line n and a straight front-side adjacent line passing the vertex n and the front-side adjacent vertex. In addition, in Step S117 it is judged whether or not the angle $\theta_R$ is smaller than the angle $\theta_F$. That is, it is judged whether or not the rear-side adjacent line is nearer to the reference line n than the front-side adjacent line. Regarding the example, H, of FIG. 24, an affirmative judgement is made in Step S117, and the control goes to Step S113 to determine the rear-side adjacent vertex as the proper division base vertex n (D'n). On the other hand, if a negative judgement is made in Step S117, the control goes to Step S118 to judge whether or not the angle $\theta_R$ is greater than the angle $\theta_F$. That is, it is judged whether or not the front-side adjacent line is nearer to the reference line n than the rear-side adjacent line. Regarding the example of FIG. 25, an affirmative judgement is made in Step S118, and the control goes to Step S115 to determine the front-side adjacent vertex as the proper division base vertex n. On the other hand, if a negative judgement is made in Step S118, namely, if the angle $\theta_R$ is equal to the angle $\theta_F$, the control goes to Step S119 to determine an angle $\theta_R$ contained by the straight line n and the rear-side adjacent line, and an angle $\theta_F$ contained by the straight line n and the front-side adjacent line. In addition, in Step S119 it is judged whether or not the angle $\theta'_R$ is smaller than the angle $\theta'_F$. That is, it is judged whether or not the rear-side adjacent line is nearer to the straight line n than the front-side adjacent line. Regarding the example of FIG. 26, an affirmative judgement is made in Step S119, and the control goes to Step S113 to determine the rear-side adjacent vertex as the proper division base vertex n. On the other hand, if the angle $\theta'_R$ is greater than the angle $\theta'_F$ as is the case with an example of FIG. 27, or if the angle $\theta'_R$ is equal to the angle $\theta'_F$, a negative judgement is made in Step S119, and the control goes to Step S115 to determine the front-side adjacent vertex as the proper division base vertex n.

After the proper division base vertex n is determined in this way, the control goes to Step S122 in which the count n is incremented by one, and subsequently the control returns to Step S107. Steps S107 through 122 are repeated with respect to each of the first aid lines beginning with the line numbered one and ending with the line numbered (N−1). If the count n coincides with the number N, an affirmative judgement is made in Step S107, and the control goes to Step S123 to find vertices for which corresponding proper division base positions have not been determined, and determine the proper division base positions for those left vertices.

In the case where the number of vertices of the upper portion of the current outline is not equal to that of the lower portion thereof, for example in the case where the former is smaller than the latter, there may be left on the lower outline portion some vertices for which corresponding proper division base positions are not determined by the execution of Steps 107 through S122. Step S123 is provided for determining proper division base positions for the left vertices. Specifically, first, on the one outline portion different from the other outline portion to which one or more left vertices belong, a pair of vertices whose division base positions (i.e., vertices) are the preceding and following vertices of the one or more left vertices, respectively, are determined. Second, a straight segment connecting the pair of vertices is divided internally by the ratios of the lengths as measured with respect to the X axis of the straight segments connecting between each pair of adjacent two vertices out of the preceding vertex, one or more left vertices and the following vertex. The thus obtained internally divided position or positions are determined as the proper division base position or positions for the left one or more vertices. Regarding an example of FIG. 29 in which the number of vertices of the lower portion of the polygon is greater than that of the upper portion thereof, the lower polygon portion has four left vertices, $P_8$, $P_9$, $P_{10}$ and $P_{11}$, between the preceding vertex P12 and the following vertex $P_7$. In this case, a straight segment connecting vertices $P_2$ and $P_3$ which correspond to the preceding and following vertices $P_{12}$, $P_7$ (i.e., division base positions for the vertices $P_2$, $P_3$), is divided internally by the same ratios as the internal division ratios of the X axis by the preceding vertex $P_{12}$, left vertices $P_{11}$, $P_{10}$, $P_9$, $P_8$ and following vertex $P_7$. The thus obtained, four internally divided positions on the segment $P_2P_3$ are determined as the proper base division positions for the vertices $P_{11}$, $P_{10}$, $P_9$, $P_8$, respectively.

Step S123 is followed by Step S124 in which the current polygon is divided into blocks by straight lines passing the vertices and the corresponding division base positions, and sets of block data each representative of an outline of a corresponding one of the blocks are prepared. The block data is modified for eliminating the effect of the previous rotation of the outline, and then is stored in the block data area 76d. Thus, one cycle of the routine of FIG. 4 is ended.

Subsequently, in Step S8 of FIG. 4 sets of index data designating all sets of block data determined in Step S124 of FIG. 10, are stored in the blocks stack area 76j. Step S8 is followed by Step S9 to judge whether or not the blocks stack area 76j is empty. In this situation, a negative judgement is made in Step S9, the control goes to Step S10 to retrieve a last-in set of index data from the blocks stack area 76j and execute Step S11 for a set of block data designated by the retrieved set of index data. In Step S11 a set of stitch position data is prepared based on this set of block data. Specifically, a plurality of stitch positions are determined on two segments of the three or four segments defining the block which two segments are opposed to each other generally in the direction perpendicular to the longitudinal direction of the current outline. According to the thus prepared set of stitch position data, a plurality of stitches are formed in the block by alternately connecting between the stitch positions provided on one of the two segments and the stitch positions provided on the other segment. FIG. 29 shows an example in which a set of block data is representative of a quadrangle $P_1P_2P_4P_3$, and a same number of stitch positions are provided equidistantly on each of the two sides $P_1P_3$, $P_2P_4$ of the quadrangle which sides are opposed to each other in the direction perpendicular to the longitudinal direction of the outline to which the quadrangle (block) belongs. The regular intervals for the upper side $P_1P_3$ may be different from that for the lower side $P_2P_4$. The prepared set of stitch position data is stored in the stitch position data area 76c. In the present embodiment, the stitch position data serves as stitch position-related data.

Steps S9 through S11 are repeated until the blocks stack area 76j becomes empty. If an affirmative judgement is made in Step S9, the control goes back to Step S5. Steps S5 through S11 are repeated until the divided outline data stack area 76k becomes empty. If an affirmative judgement is made in Step S5, the control goes to Step S12 all sets of stitch position data stored in the stitch position data area 76c are transferred to the external storage device 84. Thus, one cycle of the stitch position data preparation routine of FIG. 4 is ended.

If the operator keys in an embroidery start command through the keyboard 82 to embroider a desired area, the corresponding stitch position data are transferred from the external storage device 84 to the stitch position data area 76c of the RAM 76, and the desired area is embroidered with stitches being formed at respective stitch positions according to the stitch position data.

Figure 31:
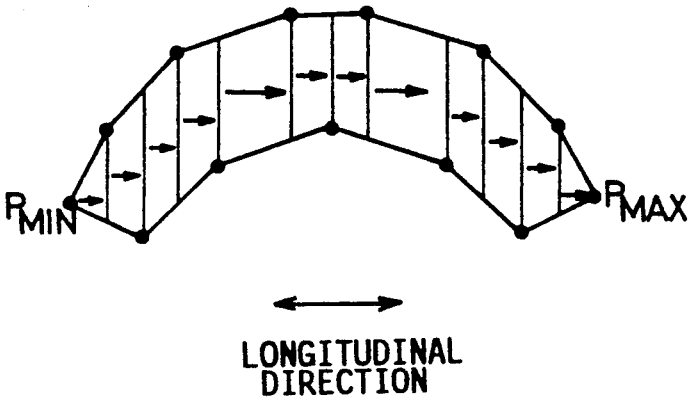
FIG. 31 is a view for explaining the division of a predetermined area into blocks which division is effected by an embroidery data preparing apparatus which has already been proposed by the Applicant.
Figure 32:
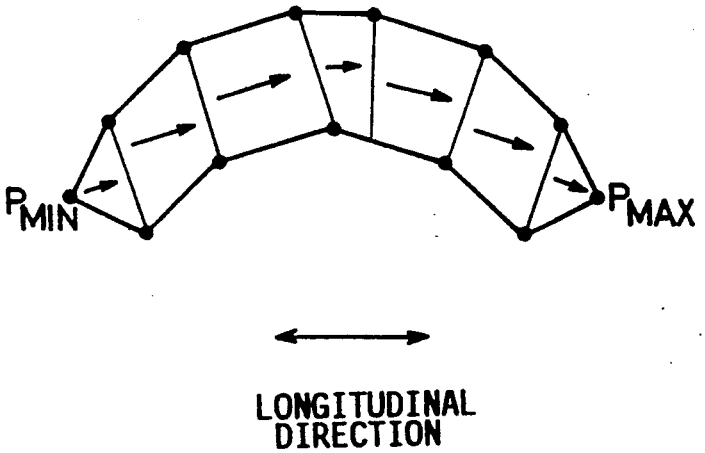
FIG. 32 is a view for explaining the division of the area of FIG. 31 into blocks which division is effected by a embodiment of the present invention.

FIG. 31 shows the blocks produced by the present system by modifying the blocks of the polygon of FIG. 30 which are produced by the apparatus which had been proposed by the Applicant before the filing of the present application. As is apparent from FIGS. 30 and 31, the blocks of FIG. 31 have more appropriate embroidering directions indicated at arrows than the blocks of FIG. 30, since the embroidering directions of the former more suitably coincide with the central-line direction of the polygon than those of the latter.

As is apparent from the foregoing description, in the present embroidery sewing machine system, Steps S41 through S49, S101 and S102 serve as direction determining means, Step S104 serves as block defining means, Steps 105 through S119, S122 and S123 serve as block modifying means, and Steps S124 and S11 serve as data producing means.

While the present invention has been described in its preferred embodiment with its particularities, it is to be understood that the present invention is by no means limited to the details of the illustrated embodiment but may be embodied with various changes, improvements and modifications that may occur to those skilled in the art without departing from the spirit and scope of the invention defined in the pending claims.

What is claimed is:

1. An apparatus for preparing stitch position-related data utilized y an embroidery sewing machine to embroider a predetermined area by forming stitches at respective stitch positions and thereby filling the area with the formed stitches, comprising:

direction determining means for determining a reference direction with respect to said area based on outline data representative of an outline of said area, said outline data including a plurality of sets of position data each of which is representative of a corresponding one of a plurality of specific positions predetermined on said outline;

block defining means for defining a plurality of straight first aid lines which are perpendicular to said reference direction and each of which passes a corresponding one of the specific positions located on a first portion of said outline and intersects a second portion of said outline different from said first portion, and thereby dividing said area and said outline into a plurality of first blocks and a plurality of first segments, respectively, each of said first blocks being enveloped by corresponding two of said first aid lines which are opposed to each other and corresponding two of said first segments which are opposed to each other;

block modifying means for modifying said first blocks by selecting, as a division base position, on of the specific positions located on said second portion of said outline which one specific position cooperates with each of the specific positions located on said first portion of said outline and associated with said first aid lines to define, in place of the first aid line passing said each associated specific positions, a division line which passes said each associated specific position on said first portion of said outline and said division base position on said second portion of said outline;

data producing means for producing as said control data stitch position-related data based on the modified blocks, said stitch position-related data relating to said stitch position where said stitches are formed to fill said area; and data utilization means for using the stitch position-related data to form the stitches.

2. The apparatus as set forth in claim 1, wherein said direction determining means determines the most distant, or approximately the most distant, two positions of said specific positions on said outline, as a maximum and a minimum position of said outline, and determines a direction of a straight line passing said maximum and minimum positions as a longitudinal direction of said outline, said longitudinal direction serving as said reference direction determined with respect to said area, said first portion of said outline being one of a pair of opposed portions of said outline which is opposed with respect to said maximum and minimum positions to the other portion serving as said second portion of said outline.

3. The apparatus as set forth in claim 2, wherein said block defining means compares a number of the specific positions located on one of said opposed portions of said outline, with a number of the specific positions located on the other portion of said outline, and determines as said first portion of said outline one of said opposed portions of said outline which one portion includes a smaller number of specific positions.

4. The apparatus as set forth in claim 3, wherein said block modifying means comprises:

means for defining a plurality of straight second aid lines which are perpendicular to said longitudinal direction and each of which passes a corresponding one of the specific positions located on said second portion of said outline and intersects said first portion of said outline, said second aid lines cooperating with said first aid lines to divide said area and said outline into a plurality of second blocks and a plurality of second segments, respectively, each of said second blocks being enveloped by corresponding two of said first and second aid lines which are opposed to each other and corresponding two of said second segments which are opposed to each other.

5. The apparatus as set forth in claim 4, wherein said block modifying means comprises:

means for determining a first vector starting at one of opposite ends of one of the opposed two segments of each of said second blocks and ending at the other end of said one segment, a second vector starting at one of opposite ends of the other segment which end is opposed to said one end of said one segment and ending at the other end of said other segment which end is opposed to said other end of said one segment, and a third vector which starts at a position on one of the opposed two aid lines of said each second block, extends in a direction of a vector obtained by addition of said first and second vectors, and ends at a position on the other aid line, the end position on each of said first and second aid lines at which the third vector determined for one of the two second blocks adjacent to said each aid line ends serving simultaneously as the start position on said each aid line at which the third vector determined for the other block starts, said minimum position serving as either the start ends or the end ends for both the first and second vectors for the block to which said minimum position belongs and simultaneously as either the start position or the end position for the block to which said minimum position belongs, while said maximum position serving as either the end ends or the start ends for both the first and second vectors for the block to which said maximum position belongs and simultaneously as either the end position or the start position for the block to which said maximum position belongs;

means for determining with respect to each of said first aid lines a fourth vector by addition of the third vectors determined for the two blocks adjacent to said each first aid line; and means for defining a straight reference line which passes the specific position associated with said each first aid line and is perpendicular to said fourth vector.

6. The apparatus as set forth in claim 5, wherein said block modifying means comprises:

means for determining an intersection of said each first aid line and said second portion of said outline, and determining two of the specific positions on said second portion which positions are adjacent to said intersection and located on both sides of said intersection, respectively, as a preceding and a following specific position of said associated specific position; and means for comparing a first angle contained by said reference line and a first straight line defined by said preceding specific position and said associated specific position, with a second angle contained by said reference line and a second straight line defined by said following specific position and said associated specific position, said block modifying means determining as said division base position one of said preceding and following specific positions which provides the smaller one of said first and second angles, said modified blocks being defined by said outline and the division lines determined with respect to said first aid lines.

7. The apparatus as set forth in claim 6, wherein said block modifying means comprises means for, if said first and second angles are equal to each other, comparing a third angle contained by said each first aid line and said first straight line, with a fourth angle contained by said each first aid line and said second straight line, said block modifying means determining as said division base position one of said preceding and following specific positions which provides the smaller one of said third and fourth angles.

8. The apparatus as set forth in claim 6, wherein said lock modifying means comprises:

first judging means for judging whether or not said preceding specific position is located between said intersection, and an intersection of said second portion of said outline and the first aid line associated with one of the two specific positions on said first portion of said outline which positions are adjacent to said specific positions associated with said each first aid line and located on both sides of said associated specific positions, respectively;

second judging means for judging whether or not said following specific position is located between said intersection, and an intersection of said second portion of said outline and the first aid line associated with the other of said two specific positions on said first portion of said outline, said block modifying means determining as said division base position a middle position of a straight segment connecting between said preceding and following specific positions if both said first and second judging means provide negative judgments, said block modifying means determining as said division base position said following specific position if said first and second judging means provide an affirmative and a negative judgment, respectively, said block modifying means determining as said division base position said following specific positions if said first and second judging means provide a negative and an affirmative judgment, respectively, said block modifying means determining said division base position based on the comparison result of said means for comparing said first and second angles, if both said first and second judging means provide affirmative judgements.

9. The apparatus as set forth in claim 6, wherein said block modifying means comprises means for determining one or more positions on said first portion of said outline which positions are not the specific positions of said first portion, as the division base positions for one or more of the specific positions on said second portion of said outline which one or more positions are not determined as the division base positions for the specific positions of said first portion of said outline.

10. The apparatus as set forth in claim 2, further comprising deflection position finding means for rotating said outline in an X-Y coordinate system so that said longitudinal direction of said outline becomes parallel to one of the X and Y axes of said X-Y coordinate system, and successively checking said specific positions in an order of location thereof on said outline, for a deflection position, by judging whether or not a sign of a value obtained by subtracting a value with respect to said one axis of a currently checked position from that of a following position which subsequently is checked, is same as that of a value obtained by subtracting a value with respect to said one axis of a preceding position which has just been checked from that of said currently checked position, said deflection position finding means finding, if a negative judgement is made, said currently checked position as said deflection position.

11. The apparatus as set forth in claim 10, further comprising deflection direction determining means for determining whether or not said deflection position is an outward deflection position, said deflection direction determining means determining, in the case where said deflection position finding means successively checks said specific positions on said outline in a clockwise direction, said deflection position as said outward deflection position if said following position of said deflection position is located on a left-hand side thereof as viewed in a direction of a vector starting at said preceding position of said deflection position and ending at said deflection position, and, in the case where said deflection position finding means successively checks said specific positions on said outline in a counterclockwise direction, said deflection position as said outward deflection position if said following position is located on a right-hand side of said deflection position as viewed in said direction of said vector.

12. The apparatus as set forth in claim 11, further comprising means for dividing said outline into first divided outlines so that each of said first divided outlines has no outward deflection position.

13. The apparatus as set forth in claim 12, further comprising means for determining the most distant, or approximately the most distant, two positions of the specific positions on said each first divided outline, and judging whether or not all the segments that connect each of said distant two positions and each of the other specific positions on said each first divided outline are contained inside said each first divided outline.

14. The apparatus as set forth in claim 13, further comprising means for dividing said each first divided outline into second divided outlines so that all the segments that connect each of the distant two positions of each of said second divided outlines and each of the other specific positions on said each second divided outline are contained inside said each second divided outline.

15. The apparatus as set forth in claim 14, wherein said direction determining means determines a direction of a straight line passing said distant two positions of said each second divided outline, as the longitudinal direction of said each second divided outline.

16. The apparatus as set forth in claim 14, wherein said block defining means divides said each second divided outline into said first blocks, said block modifying means modifies each of said first blocks, and said data producing means produces as said stitch position-related data block data representative of each of the modified blocks.

17. The apparatus as set forth in claim 1, wherein said data producing means comprises means for producing, as said stitch position-related data, block data representative of each of said modified blocks, said block data comprising two sets of position data representative of the two specific positions associated with the opposed two first aid line of each of said first blocks and two sets of position data representative of the division base positions determined with respect to said opposed two first aid lines.

18. The apparatus as set forth in claim 17, wherein said data producing means further comprises means for producing based on said block data stitch position data representative of stitch positions which said embroidery sewing machine alternately connects with thread to form said stitches and thereby fill said area with the formed stitches, said stitch position data serving as said stitch position-related data.

19. The apparatus as set forth in claim 1, wherein said outline comprises a polygon and said specific positions comprise a plurality of vertices of said polygon, said data producing means comprising means for producing as said stitch position-related data block data representative of each of said modified blocks, said block data comprising two sets of positions data representative of the two vertices associated with the opposed two first aid lines of each of said first blocks and two sets of position data representative of the two division base positions determined with respect to said opposed two first aid lines.

20. The apparatus as set forth in claim 1, wherein said block modifying means selects, as said division base position, one of the specific positions located on the two first segments which respectively belong to the two first blocks adjacent to, and on both sides of, said first aid line passing said each associated specific position on said first portion of said outline.

* * * * *